US008037634B2

(12) United States Patent
Price

(10) Patent No.: US 8,037,634 B2
(45) Date of Patent: Oct. 18, 2011

(54) GUN SIGHT FEATURING POINT-TO-POINT ALIGNMENT

(76) Inventor: Donald H. Price, Eugene, OR (US)

( * ) Notice: Subject to any disclaimer, the term of this patent is extended or adjusted under 35 U.S.C. 154(b) by 0 days.

(21) Appl. No.: 12/927,468

(22) Filed: Nov. 15, 2010

(65) Prior Publication Data

US 2011/0067286 A1 Mar. 24, 2011

Related U.S. Application Data

(60) Continuation of application No. 12/313,482, filed on Nov. 18, 2008, now Pat. No. 7,832,138, which is a division of application No. 11/010,115, filed on Dec. 10, 2004, now Pat. No. 7,451,566.

(51) Int. Cl.
*F41G 1/08* (2006.01)

(52) U.S. Cl. ..... 42/133; 42/111

(58) Field of Classification Search ..... 42/132, 42/133, 134, 144, 145; D22/108, 109, 110
See application file for complete search history.

(56) References Cited

U.S. PATENT DOCUMENTS

| | | | | | |
|---|---|---|---|---|---|
| 882,182 | A | * | 3/1908 | Thompson et al. | 42/144 |
| 1,171,310 | A | * | 2/1916 | Bisbee et al. | 42/144 |
| 1,268,537 | A | * | 6/1918 | Bader et al. | 42/144 |
| 1,358,015 | A | * | 11/1920 | Pen | 42/136 |
| 1,363,553 | A | * | 12/1920 | Barringer | 42/145 |
| 1,755,635 | A | * | 4/1930 | Dindinger | 42/144 |
| 2,706,335 | A | * | 4/1955 | Munsey | 42/145 |
| RE24,313 | E | * | 5/1957 | Munsey et al. | 42/145 |
| 3,187,436 | A | | 6/1965 | Friedrichsmeier | |
| 3,439,970 | A | * | 4/1969 | Rickert | 42/131 |
| 4,479,307 | A | * | 10/1984 | Pomeranz | 42/133 |
| 4,745,698 | A | * | 5/1988 | Schwulst | 42/132 |
| D296,227 | S | * | 6/1988 | Novak | D22/109 |
| D351,449 | S | * | 10/1994 | Dagley | D22/109 |
| D361,366 | S | * | 8/1995 | Emerson | D22/109 |
| D363,334 | S | * | 10/1995 | De Oliveira Masina | D22/109 |
| D382,038 | S | | 8/1997 | Nigh | |
| 5,822,872 | A | * | 10/1998 | Waki | 42/111 |
| D403,734 | S | * | 1/1999 | Kay | D22/109 |
| 6,035,539 | A | | 3/2000 | Hollenbach | |
| 6,058,615 | A | * | 5/2000 | Uhlmann et al. | 42/132 |
| D428,102 | S | * | 7/2000 | Flubacher et al. | D22/109 |
| D432,618 | S | * | 10/2000 | Wilson | D22/109 |
| D435,080 | S | * | 12/2000 | Ling, Jr. | D22/109 |
| D435,282 | S | * | 12/2000 | Ling, Jr. | D22/109 |
| D436,393 | S | * | 1/2001 | Ling, Jr. | D22/109 |
| 6,216,351 | B1 | * | 4/2001 | Flubacher et al. | 42/145 |
| D443,016 | S | * | 5/2001 | Nigh | D22/109 |
| 6,233,836 | B1 | * | 5/2001 | Uhlmann et al. | 42/145 |
| 6,678,987 | B2 | * | 1/2004 | Howe | 42/132 |
| 6,711,846 | B1 | * | 3/2004 | Nasef | 42/130 |
| D489,115 | S | * | 4/2004 | Nasef | D22/109 |
| D492,747 | S | * | 7/2004 | LoRocco | D22/109 |
| 6,804,908 | B1 | * | 10/2004 | Hanson et al. | 42/148 |
| 2002/0066220 | A1 | * | 6/2002 | Malley | 42/133 |
| 2004/0010956 | A1 | * | 1/2004 | Bubits | 42/144 |

* cited by examiner

*Primary Examiner* — Benjamin P Lee
(74) *Attorney, Agent, or Firm* — Heisler & Associates

(57) ABSTRACT

A gun sight system featuring point-to-point visual alignment is provided. A front sight coupled to a forward end of a gun includes a top sighting point and optionally lateral sighting points. A rear sight coupled to a rearward end of the gun includes a pair of spaced apart rear lateral sighting points each visually alignable with and visually touching one of the front lateral sighting points or the top sighting point for visually touching the top sighting point with a target while simultaneously visually aligning at least one of the rear lateral sighting points with a point on the front sight.

11 Claims, 9 Drawing Sheets

Fig. 13
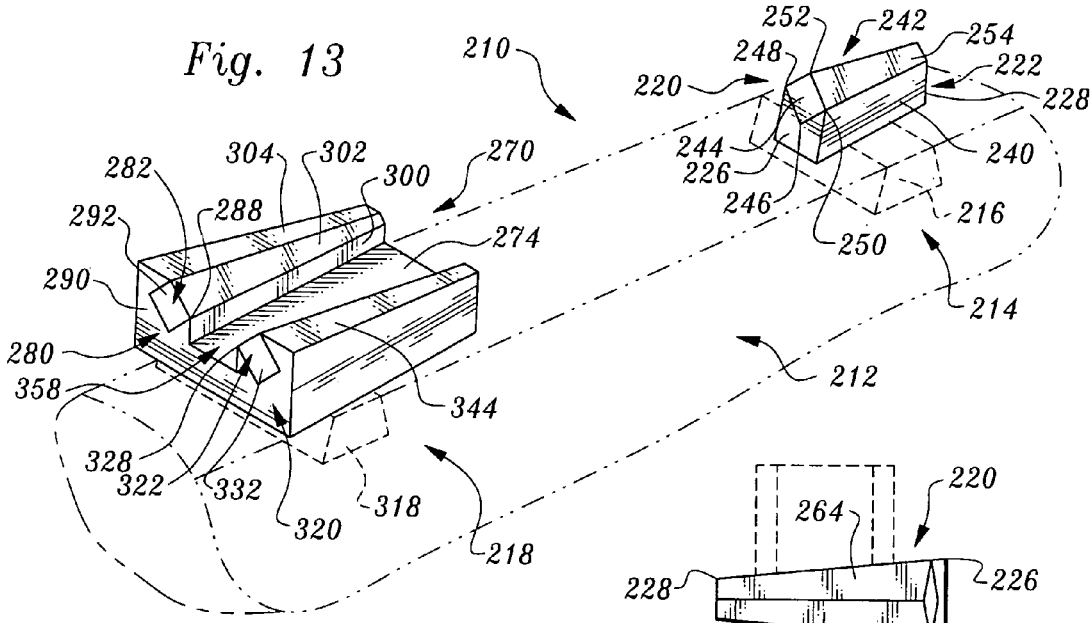
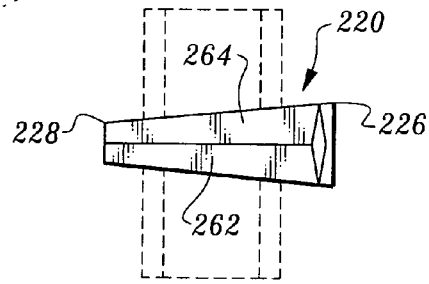
Fig. 15
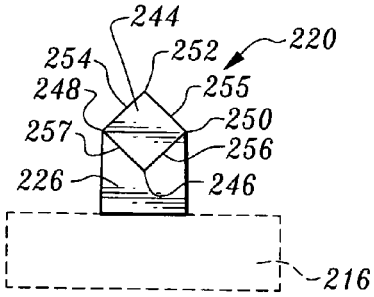
Fig. 14
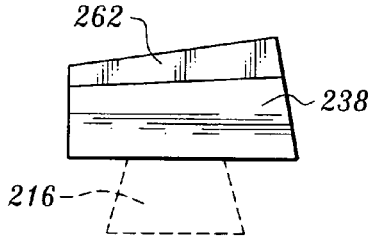
Fig. 16
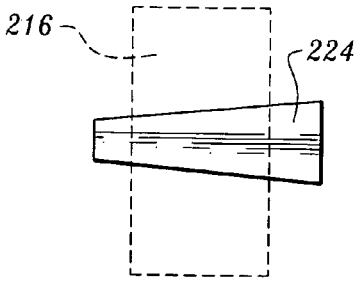
Fig. 17
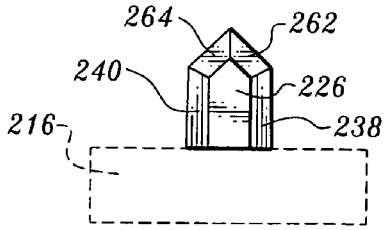
Fig. 18

Fig. 36
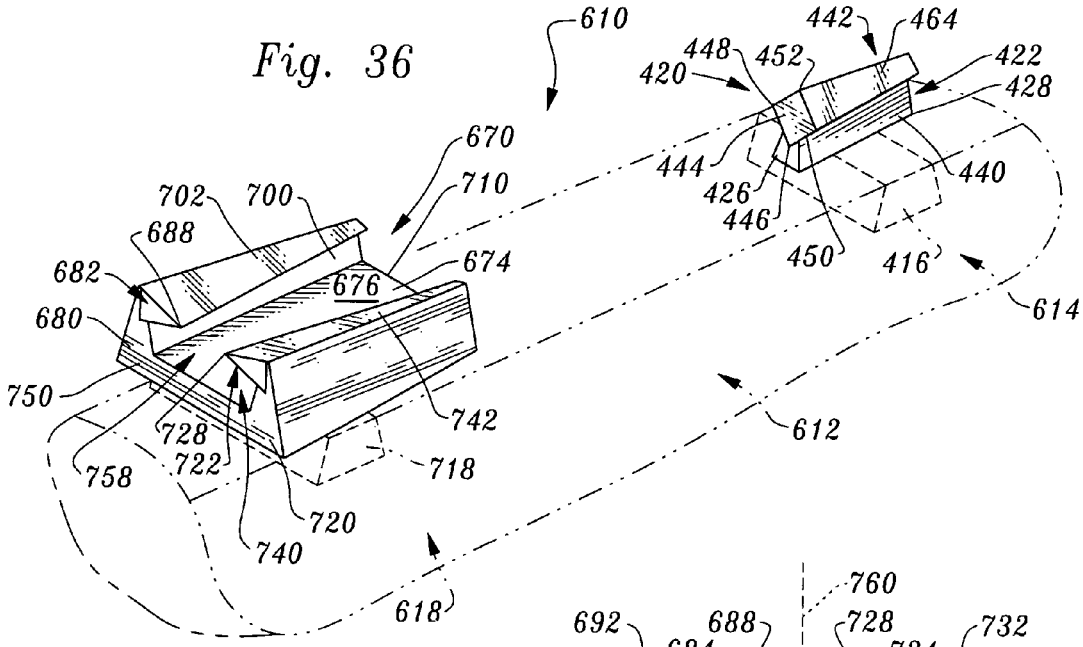
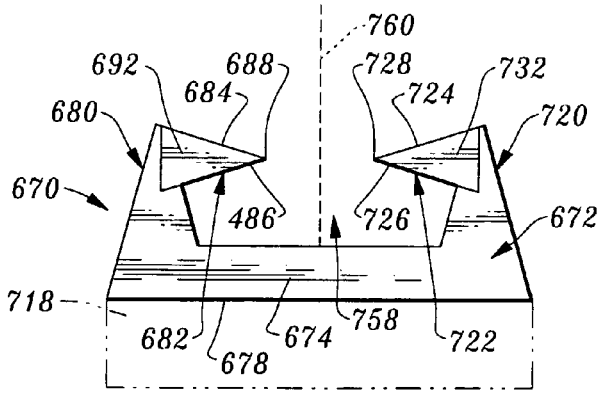
Fig. 37
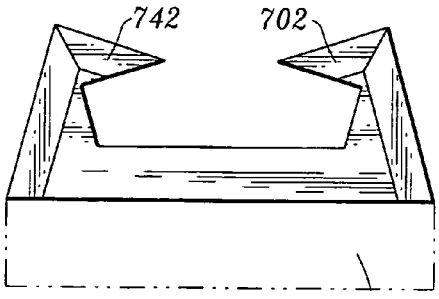
Fig. 38
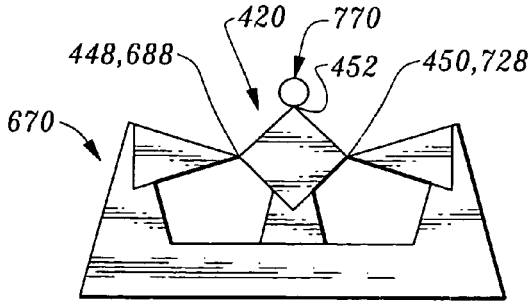
Fig. 39

GUN SIGHT FEATURING POINT-TO-POINT ALIGNMENT

CROSS-REFERENCE TO RELATED APPLICATIONS

This application is a continuation of U.S. patent application Ser. No. 12/313,482, filed on Nov. 18, 2008 now U.S. Pat. No. 7,832,138 which is a divisional of U.S. patent application Ser. No. 11/010,115, filed on Dec. 10, 2004 and issued as U.S. Pat. No. 7,451,566 on Nov. 18, 2008.

FIELD OF THE INVENTION

This invention relates generally to gun sight systems and, in particular, to gun sight systems featuring point-to-point alignment and visual contact of a front sight to a rear sight and a target for use with all types of guns including pistols, rifles, and shotguns.

BACKGROUND OF THE INVENTION

Traditional gun or firearm sighting systems include a sighting device on the rear and front of the gun. These two sighting devices have various visual references, which, when aligned, are then referenced with the intended target, producing a "sight picture" whose purpose is to align the barrel of the firearm, and thus the projectile, as closely with the target as possible.

The most common form of traditional sight, known also as "iron sights" includes a front sight and a rear sight. The rear sight includes a solid, opaque, rectangular block having a central notch disposed therein and mounted crosswise on the rear end of a gun. The front sight includes a front rectangular post mounted on a front end of a gun barrel. A shooter looks through the central notch of the rear sight, and attempts to make the front rectangular post of the front sight appear to fill the gap in the central notch.

Specifically, proper sighting is assumed when a flat top surface of the front rectangular post appears to be even with a flat top surface of the rear notched sight, and additionally, when two opposing flat sides of the post appear to be exactly centered in between two interior flat surfaces that comprise the left and right edge of the cut out notch or gap in the rear sight. The user attempts to achieve this by guessing when the two apparent gaps between the left and right sides of the front post are identically spaced, in apparent relation to the left and right sides of the square notch in the rear sight. This attempts to account for the left to right alignment of the barrel. The user must then also examine the flat upper surfaces of the front and rear sights for alignment as well. This accounts for the vertical alignment of the barrel. Finally, while holding these in alignment, the user must then align a general area of a top of the square front post with a general area of an intended target.

A number of less common variations of gun sights exist in the form of, for example, a bead front sight comprised of a small round bead mounted on top of a post; a V-shaped notched rear sight; and a peep sight defined by having a fully enclosed round opening on the rear sight, which is indexed to a bead on a front post.

Less common variations include front sights which are triangle or diamond shaped, or circular. Some notch and post type gun sights, particularly on pistols, have a white round dot on the front post and one white dot on the left and right sides of the rear sights also. These are supposed to be judged and aligned together in an even row, along with the target.

All these variations, however, have a common and consistent theme: all have open spaces or gaps which are the only references for proper alignment. This theme prevails throughout the geometric sights shapes of the known prior art.

For example, U.S. Pat. No. 882,182 issued on Mar. 17, 1908 to Thompson discloses a front sight for a firearm. The stated purpose of this device is to simply provide a brightened, higher contrast front sight picture to aid in target acquisition. Column 1, lines 9-18 state "The present invention provides a novel form of sight to be fitted to the front of small firearms . . . the sight embodying an indicator of contrasting color . . . readily discerned by reason of striking contrast between it and the body." A variation includes an apex which in operation is turned sideways such that a broad rectangular side having indicator (3*a*) thereon is facing toward the shooter's eye. Hence, the sighting indicator is a traditional, flat topped sight intended for use with traditional square rear notched sights. Accordingly, this system still requires mental estimation.

U.S. Pat. No. 1,171,310 issued on Feb. 8, 1916 to Bisbee discloses a front sight and states at column 1, lines 14-20 that "In order to accomplish the desired result use is made of a front sight having a sloping bright surface of the sight leading to the sighting point on the top of the sight to enable the user of the firearm to readily see the sighting point through the notch or opening in the breech sight." Though one part of the front sight does exhibit a diamond shape with facets/points, this is intended only as a reference between the front sight and the target, not between the front and rear sights. It is intended to be used with conventional rear sights. Hence, this system still requires mental estimation.

U.S. Pat. No. 1,268,537 issued on Jun. 4, 1918 to Bader teaches a front sight for firearms which is also intended as a visual variation on the front sight alone and involves circles and other curved lines to aid in target acquisition, with no mention of any apex/points or alignment of any sort with the rear sight. This system also still requires mental estimation.

U.S. Pat. No. 1,755,635 issued on Apr. 22, 1930 to Dindinger teaches a gun sight and states at column 1, lines 3-4 that "The primary object of this invention is to provide a novel construction of foresight, which may be used advantageously in connection with any practical and well known form of rear sight opening . . . ." Dindinger is mainly concerned with a less obstructed front sight picture as well as with light reflective coatings to improve visibility and contrast. This sighting system still requires mental estimation.

U.S. Pat. No. 2,706,335 issued on Apr. 19, 1955 to Munsey teaches a gun sight mainly concerned with the use of a fiber optic, end emitting plastic tube in the front sight, for a higher contrast front sight picture. One of its proposed variations, number 32, does have a point/apex, but like Bisbee above, this also is intended as a reference between the front sight and target only, and teaches no unique alignment with the rear sight. Hence, this system still requires mental estimation.

U.S. Pat. No. D382,038 issued on Aug. 5, 1997 to Nigh teaches an ornamental design for a geometric firearm sight, as shown in the drawings which requires mental estimation.

U.S. Pat. No. 5,822,872 issued on Oct. 20, 1998 to Waki teaches an open blade rear sight for pistol, rifle or shotgun and is concerned with providing an opening below the square or rectangular notch found in the upper surface of the traditional rear sight, for a more unobstructed view of the target as stated at column 1, lines 20-23. Hence, this system still requires mental estimation.

Lastly, U.S. Pat. No. 6,058,616 issued on May 9, 2000 to Bubits teaches a sighting device for small arms and states on column 2, lines 2-7 that "The two converging unobstructed gaps which are produced between the sides of the trapezoidal rear notch sight cutout and the sides of the triangular outline of the front sight lead the eye—assisted by the contrast strips—toward the target and, in addition, are used for horizontal adjustment." Thus, Bubits teaches a sighting system that clearly requires mental estimation wherein the gaps themselves are the references, and the mind must fill in and guess when they are both aligned properly with the front triangle. This concept of "gaps and guesses" is exactly the same as traditional "notch and post sights," other than the slopes and angles.

Accordingly, this prevalent theme in all of the known prior art of requiring mental estimation due to intentional gaps and spaces between the various reference surfaces is problematic in that a subconscious mind must struggle to take what visual information is provided, fill in the gaps literally, and then estimate or essentially guess when alignment is present. Because of the relative paucity of exact visual information relayed to the mind, acquiring even moderate proficiency with known prior art gun sight systems requires years of regular and frequent practice to train and coordinate the eyes, body and mind. No matter whether the gaps are sloped surfaces, diamonds or circles, the intended gaps still require the mind to fill in the space intentionally left, and then reference this alignment also with the target. This requires a tremendous amount of subconscious mental effort and is the main impediment to easy and accurate shooting and the reason why proficiency with any sort of firearm currently requires years of practice to master. This has profound implications not only for recreational target shooters, but especially for those in law enforcement and the military, where funding and training time is limited, yet speed and accuracy can often be a matter of life and death.

For the foregoing reasons, there is need for a gun sighting system that addresses the above delineated deficiencies in the known prior art gun sighting systems. Particularly, there is a need for a gun sighting system that substantially eliminates mentally estimating or guessing as to when alignment is present. Also, there is a need for a gun sighting system that is designed to work with the actual physiology of the eye and mind, thus substantially eliminating mental estimation or guessing when alignment is present.

SUMMARY OF THE INVENTION

The present invention is distinguished over the known prior art in a multiplicity of ways. For one thing, an embodiment of the invention provides a gun sight system comprised of visual references which are exact points in space that are designed to be visually touched or indexed with each other and a target for providing a "touch the points, pull the trigger" gun sight system. Hence, one embodiment of the invention provides a gun sight system that substantially eliminates the gaps and guesses or estimations of alignment associated with traditional gun sight systems and their many variations by providing absolute visual reference points in space, rather than surfaces, which when visually touched, determine proper alignment of the front and rear sights, and their relation to the target.

In one embodiment, the present invention provides a gun sight system comprised of a front sight attached to a forward end of a barrel of a gun and including a front face having a front upper sighting point and a front lower sighting point. The gun sight system further comprises a rear sight attached to a rearward end of the gun behind the front sight and including a forward face having a rear sighting point juxtaposed to the front lower sighting point for indexing by visually touch the rear sighting point with the front lower sighting point. The rear sighting point can be juxtaposed in a substantially gap-less relation to the front lower sighting point and can visually touch the front upper sighting point with a target. Accurate alignment of the gun barrel (and a projectile emanating therefrom) with the target is provided for a "touch the points, pull the trigger" gun sight system.

In another embodiment, the present invention provides a gun sight system comprised of a front sight coupled to a forward end of a gun and including a front face having a top sighting point and a pair of opposing front lateral sighting points, and a rear sight coupled to a rearward end of the gun behind the front sight and including a pair of spaced apart rear lateral sighting points each respectively juxtaposed to one of the pair of opposing front lateral sighting points such that visually touching the top sighting point of the front sight with an area on a target while simultaneously visually touching at least one of the rear lateral sighting points with its respective juxtaposed front lateral sighting point in a substantially laterally gap-less relation provides accurate alignment of the gun and a projectile emanating therefrom with the target for providing a "touch the points, pull the trigger" gun sight system.

In another embodiment, the present invention provides a gun sight system comprised of a front sight coupled to a forward end of a gun and including a front face having a top sighting point and a pair of opposing front lateral sighting points and a rear sight coupled to a rearward end of the gun behind the front sight and including a base plate having a pair of spaced apart sidewalls upwardly extending from opposite sides of the base plate for defining a left sidewall and a right sidewall and a sight opening therebetween. The rear sight further includes a first inwardly projecting member extending from an upper end of the left sidewall toward the right side wall and terminating to a first end point within the sight opening, and a second inwardly projecting member extending from an upper end of the right sidewall toward the left side wall and terminating to a second end point within the sight opening wherein the first and second end points define a pair of opposing spaced apart rear lateral sighting points each respectively juxtaposed to one of the pair of opposing front lateral sighting points such that visually touching the top sighting point of the front sight with an area on a target while simultaneously visually touching at least one of the rear lateral sighting points with its respective juxtaposed front lateral sighting in a substantially laterally gap-less relation provides accurate alignment of the gun and a projectile emanating therefrom with the target for providing a "touch the points, pull the trigger" gun sight system.

In another embodiment, the present invention provides a gun sight system comprised of a pyramid shaped front sight attached to a forward end of a barrel of a gun and including an uppermost end terminating to a front sighting point; a pair of spaced apart upwardly and inwardly slanting pyramid shaped rear sights attached to a rearward end of the gun behind the front sight and including a pair or uppermost ends terminating to a pair of spaced apart rear sighting points each respectively juxtaposed to the front sighting point such that visually touching the rear sighting points with the front sighting point and the front sighting point with the target defines a convergence of rear and front sighting points to the target for providing accurate alignment of the gun barrel and a projectile emanating therefrom with the target for providing a "touch the points, pull the trigger" gun sight system. Additionally, and in one embodiment of the invention, the pyramid shaped front sight includes a front face substantially shaped as an isosceles triangle. Furthermore, and in one embodiment of the invention, the pyramid shaped rear sights include front faces substantially shaped as scalene triangles each scalene triangle having its shortest length acting as a base and its longest length defining an exterior side such that the scalene triangles upwardly and inwardly converge toward one another such that the front sight is spaced in front of and interposed therebetween, and all three appear to converge and visually touch with each other and the intended target at one point in space.

In one embodiment of the invention, these front and rear sights may utilize bright and/or contrasting colors to heighten visual tracking by peripheral vision of a user. Additionally, and in one embodiment of the invention, the addition of fine lines of contrasting colors within these front and rear sights may also be used to heighten visual tracking by peripheral vision of a user. Alternatively, these fine lines and geometrically shaped visual indicators, in white or of various contrasting colors, might be formed of a plastic with fiber optic qualities, and/or embedded in a base structure manufactured of a clear material, such as Lexan. Such fiber optic material could also be further illuminated from within the base structure by an embedded self-luminescent source such as Tritium. Furthermore, and in one embodiment of the invention, the tops of these front and rear sights may be physically sloped away from the user's eye, using depth perception to further stimulate the focal vision's instinct to be drawn to areas of finer detail. These elements can be combined to function together wherein the peripheral vision is attracted to and locks onto the bright colors/geometrical shaped front and rear sights whose interior lines and converging angles draw the focal vision to the area of finest detail or to exact points in space whose alignment/convergence and visual contact reveals the point of impact of a gun shot.

Moreover, an embodiment of the invention provides a gun sight system that is relatively simple in construction, rugged, and inexpensive to manufacture.

Accordingly, having thus summarized the invention, it should be apparent that numerous modifications and adaptations may be resorted to without departing from the scope and fair meaning of the present invention as set forth hereinbelow by the claims.

BRIEF DESCRIPTION OF THE DRAWINGS

FIG. 13 is a perspective view of another embodiment of a gun sight system including a front sight and a rear sight shown mounted on a gun illustrated in fragment and phantom.

FIG. 14 is a front plan view of the front sight shown in FIG. 13.

FIG. 15 is a top plan view of the front sight shown in FIG. 13.

FIG. 16 is a side plan view of the front sight shown in FIG. 13.

FIG. 17 is a bottom plan view of the front sight shown in FIG. 13.

FIG. 18 is a back plan view of the front sight shown in FIG. 13.

FIG. 36 is a perspective view of another embodiment of a gun sight system including a front sight and a rear sight shown mounted on a gun illustrated in fragment and phantom.

FIG. 37 is a front plan view of the rear sight shown in FIG. 36.

FIG. 38 is a back plan view of the rear sight shown in FIG. 36.

FIG. 39 is a front plan view of aligned front and rear sights of the gun sight system shown in FIG. 36, and with a target shown as a dot aligned with the sighting system.

DESCRIPTION OF THE PREFERRED EMBODIMENT

Figure 1:
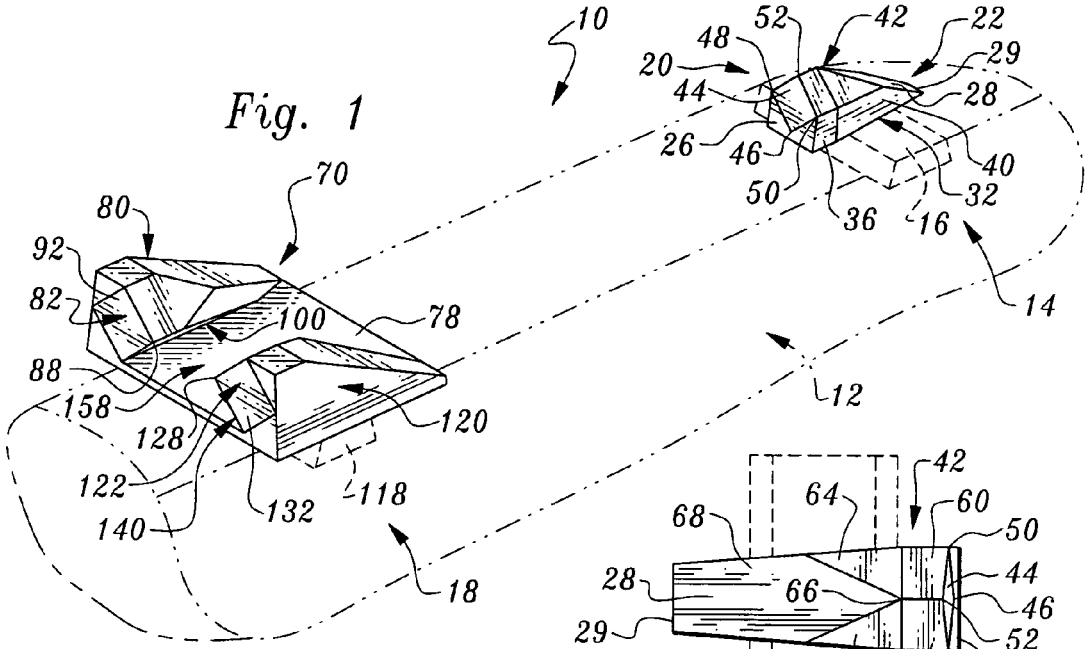
FIG. 1 is a perspective view of an embodiment of a gun sight system including a front sight and a rear sight shown mounted on a gun illustrated in fragment and phantom.

In its essence, and referring to the drawings wherein like reference numerals denote like parts throughout the various drawing figures, this invention provides a gun sight system comprised of visual references that are exact points in space, rather than surfaces. The visual references can be visually touched to each other and a target for providing a "touch the points, pull the trigger" sighting system, rather than requiring alignment of surfaces consistent with how the mind most easily processes visual information.

Figure 12:
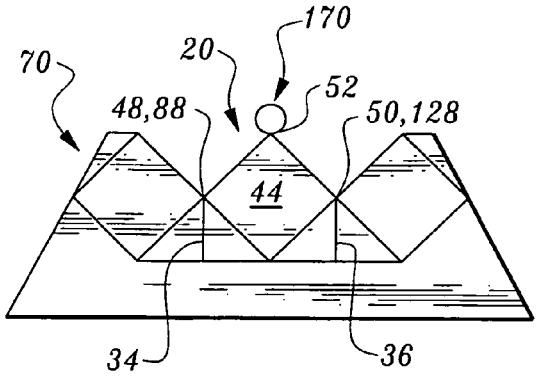
FIG. 12 is a front plan view of aligned front and rear sights of the gun sight system shown in FIG. 1, and with a target shown as a dot aligned with the sighting system.

In essence, and referring to FIGS. 1 and 12, one embodiment of the present invention provides a gun sight system 10 comprised of a geometrically shaped front sight 20 and a geometrically shaped rear sight 70 as shown FIG. 1. The geometrically shaped front sight 20 is coupled to a forward end 14 of a gun 12 and comprises a front face 44 having a peripheral outline converging to a top sighting point 52 and a pair of opposing front lateral sighting points 48, 50. The geometrically shaped rear sight 70 is attached to a rearward end 18 of the gun 12 behind the front sight 20 and comprises a pair of spaced apart upwardly extending sidewalls 80, 120 having a sight opening 158 therebetween. Each sidewall 80, 120 includes inwardly projecting members 82, 122 each terminating to respective common points 88, 128 adjacent the sight opening 158 for defining a pair of opposed spaced apart rear lateral sighting points 88, 128 each alignable with one of the pair of opposing front lateral sighting points 48, 50. Proper sight alignment occurs by visually touching either or both of the rear lateral sighting points 88, 128 with its respective juxtaposed front lateral sighting point 48, 50 such that the visually touched points are juxtaposed in a substantially laterally gap-less relation as shown in FIG. 12. The user simultaneously visually touches the top sighting point 52 of the front sight 20 with an area on a target 170 for providing accurate alignment of the gun 12 with the target. A "touch the points, pull the trigger" gun sight system 10 is thus provided.

More specifically, and referring to FIGS. 1-12, one embodiment the present invention provides a gun sight system 10 comprised of a geometrically shaped front sight 20 and a geometrically shaped rear sight 70 featuring point-to-point alignment for use with a gun or firearm 12 such as, for example, a trigger actuated pistol, rifle, or shotgun. The geometrically shaped front sight 20 is preferably formed from a single monolith of material and comprises a lowermost rectangular portion 22 surmounted by an upper faceted portion 42.

As shown in FIG. 1, the lowermost rectangular portion 22 longitudinally extends along a forward end 14 of the gun 12 and is operatively coupled thereto by a dove tail shaped base portion 16 being set crosswise to and downwardly extending from a substantially planar bottom surface 24 (FIG. 5) of the lowermost rectangular portion 22 of the front sight 20 and being fitted to the forward end 14 of the gun 12 in a conventional manner. The base portion 16 may of course be of any desired sectional form and may be integrally formed with the lowermost rectangular portion 22 or attached to the lowermost rectangular portion 22 of the front sight 20 by attachment methods such as by screw, welding, or adhesive. Additionally, the lowermost rectangular portion 22 may take different sectional forms and be attached to the upper faceted portion 42 by being integrally formed therewith or attached thereto by attachment methods such as by screw, welding, or adhesive.

Referring to FIG. 1 and FIGS. 4-6, the lowermost rectangular portion 22 further includes a front side 26, a rear side 28 tapering to a rear tip 29, and a pair of sidewalls 30 and 32 (FIG. 6) extending upwardly from the substantially planar bottom surface 24 and transitioning into the upper faceted portion 42 of the front sight 20. Sidewalls 30 and 32 respectively include front sidewall portions 34 (FIG. 4) and 36 (FIG. 1) which both rearwardly extend from the front side 26 of the lowermost rectangular portion 22. The sidewall portions 34, 35 terminate at rearwardly extending and inwardly tapering sidewall portions 38 (FIG. 4) and 40 (FIG. 2) which, in turn, terminate to the tapering rear side 28 of the lowermost rectangular portion 22, such that the lowermost rectangular portion 22 tapers from the front side 26 to the rear side 28.

Figure 3:
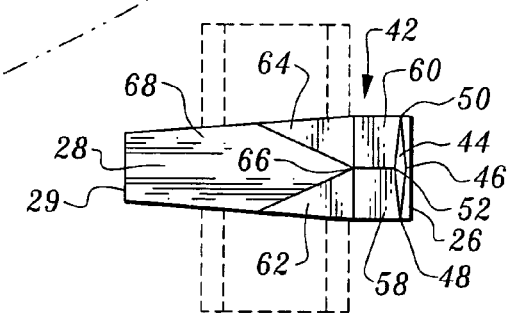
FIG. 3 is a top plan view of the front sight shown in FIG. 1.
Figure 2:
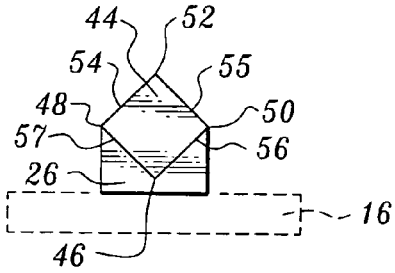
FIG. 2 is a front plan view of the front sight shown in FIG. 1.
Figure 4:
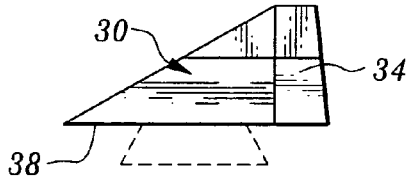
FIG. 4 is a side plan view of the front sight shown in FIG. 1.
Figure 5:
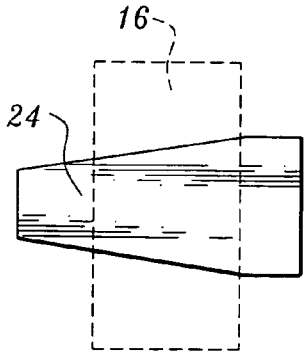
FIG. 5 is a bottom plan view of the front sight shown in FIG. 1.
Figure 6:
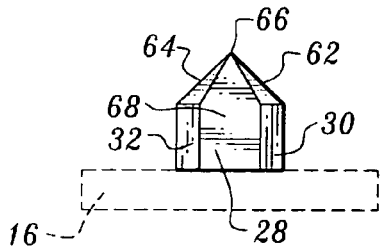
FIG. 6 is a back plan view of the front sight shown in FIG. 1.

Referring to FIGS. 1-3, the upper faceted portion 42 surmounts the lowermost rectangular portion 22 and comprises a substantially diamond shaped front face 44 defined by a square shape which is rotated 45° to have one lower point 46 and a pair of opposed front lateral sighting points 48 and 50 that form front lower vertices which extend horizontally to either side, and an apex defining a top sighting point 52 which extends vertically upwards. This diamond shaped front face 44 includes two pair of substantially parallel front side edges 54, 56 and 55, 57 defining a peripheral outline of the front face 44. The front side edges 54, 55 define a pair of top edges (also called upper edge lines) and the front side edges 56, 57 define a pair of bottom edges (also called lower edge lines). Preferably, the upper faceted portion 42 is contoured to substantially eliminate extra material visually protruding beyond front side edges 54, 55, 56, and 57 of the diamond shaped front face 44, for minimizing visual interference with visualization of the sighting points and target.

The edges 56, 57 can have geometric form, such as by defining a roughened line or trough, or can be defined by paint or other visually perceptible material, to clearly show the edges 56, 57. Any such paint or other material can also be located adjacent the edges 54, 55.

Specifically, the upper faceted portion 42 is contoured to substantially eliminate extra material protruding from front side edges 54, 55 and comprises a pair of opposed top side rectangular relief cuts 58, 60 respectively followed by a pair of opposed top side triangular relief cuts 62, 64 formed by removing material behind the top sighting point 52, the front lateral sightings points 48 and 50, and the pair of top side front edges 54 and 55. The pair of opposed top side triangular relief cuts 62, 64 extend rearwardly and downwardly from a common point 66 and transition into a rear relief cut 68 which extends rearwardly and downwardly from the common point 66 and an area between the pair of opposed triangular relief cuts 62, 64 to form the tapering rear side 28 of the lowermost rectangular portion 22 of the front sight 20.

Figure 7:
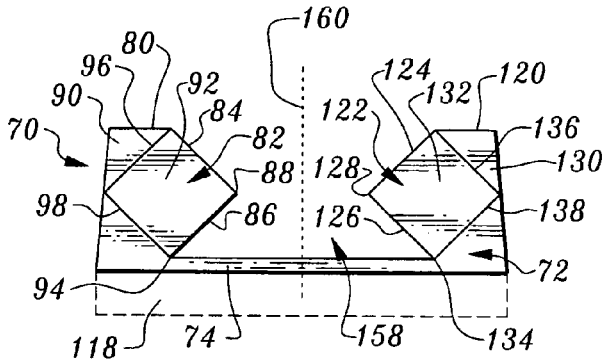
FIG. 7 is a front plan view of the rear sight shown in FIG. 1.
Figure 9:
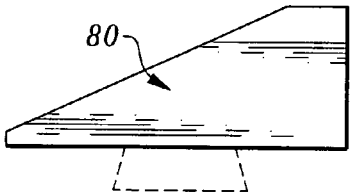
FIG. 9 is a side plan view of the rear sight shown in FIG. 1.
Figure 11:
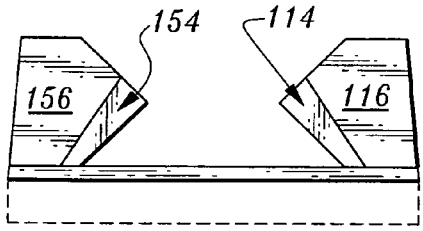
FIG. 11 is a back plan view of the rear sight shown in FIG. 1.
Figure 10:
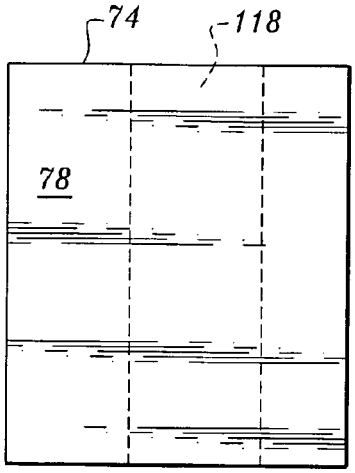
FIG. 10 is a bottom plan view of the rear sight shown in FIG. 1.

Referring to FIGS. 1, 7 and 12, the gun sight system 10 further comprises the geometrically shaped rear sight 70 preferably formed from a single monolith of material and comprised of a rear sight block member 72 which includes a substantially rectangular base plate or member 74 having a substantially planar upper surface 76 and a substantially planar bottom surface 78. The rear sight block member 72 is coupled to a rearward end 18 of the gun 12 in a crosswise orientation as shown in FIG. 1 wherein a dove tail base portion 118 downwardly extends from and is operatively coupled to the substantially planar bottom surface 78 of the substantially rectangular base member 74 and is fitted to the rearward end 18 of the gun 12 in a conventional manner.

Referring to FIGS. 1 and 7, the rear sight block member 72 further comprises a pair of spaced apart sidewalls 80, 120 disposed on opposite sides of the substantially rectangular base member 74 and upwardly extending from the upper surface 76 for defining a sight opening 158 therebetween. The spaced apart sidewalls 80, 120 respectively include inwardly projecting members 82, 122 each terminating to a respective pair of non-parallel front edges 84, 86 and 124,126 wherein each pair of non-parallel front edges 84, 86 and 124,126 terminate to respective common end points 88, 128 that form rear vertices disposed within the sight opening 158 and on each opposing side of a vertical intervening axis 160 for defining a pair of opposed spaced apart rear lateral sighting points 88, 128. These non-parallel front edges are also called rear upper edge lines and rear lower edge lines.

Referring to FIG. 7, sidewall 80 includes a left sidewall comprised of a front surface 90 having a substantially diamond shaped front face 92 defined by a square shape turned 45° onto one point 94 for defining the inwardly projecting member 82 terminating to the rear lateral sighting point 88. Similarly, sidewall 120 includes a right sidewall comprised of a front surface 130 having a substantially diamond shaped front face 132 defined by a square shape turned 45° onto one point 134 for defining the inwardly projecting member 122 terminating to the rear lateral sighting point 128 in an opposing relation relative to rear lateral sighting point 88.

Lines 96, 98 and 136, 138 are preferably not defining a surface contour transition. Rather, these lines 96, 98 and 136, 138 are preferably provided with paint or other visually perceptible coating material or inserts of plastic or other suitable material. In this way, the front faces 92, 132 can take on a full diamond shaped appearance. The appearance to the user of a "point-to-point" configuration may vary slightly depending on the demands and limitations of varying manufacturing methods and materials, and with various lighting and target conditions encountered by the user. For example, if white plastic inserts or paint is used, a very thin rim of darker material will appear around the outer edge of the visual indicator. Depending on the ambient lighting conditions, either the darker "points" of the rim material, or the lighter "points" of the pigmented visual indicator may be more visible.

Figure 8:
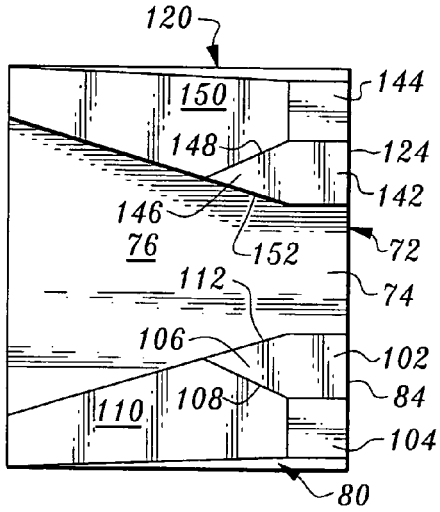
FIG. 8 is a top plan view of the rear sight shown in FIG. 1.

Referring to FIGS. 1 and 8, the sight opening 158 preferably defines a central portion cut out of the rear sight block which is contoured around the pair of opposed spaced apart rear lateral sighting points 88, 128 of the two diamond shaped front faces 92, 132 to substantially eliminate extra material visually protruding beyond sides 84, 86, and 124, 126 of the respective diamond shaped front faces 92, 132 such that the front lateral sighting points 48, 50 of the front sight 20 can be visualized clearly and exactly between the pair of opposed spaced apart rear lateral sighting points 88, 128 of the rear sight 70.

In one embodiment, the sight opening 158 is contoured by providing longitudinal undercuts 100, 140 on interior lower most portions of the left and right sidewalls 80,120 respectively. Undercuts 100 and 140 extend rearwardly from respective sides 86, 126 and respectively converge to the substantially planar upper surface 76 of the substantially rectangular base plate 74.

Additionally, top side cuts 102, 142 are respectively made on interior upper portions of the left and right sidewalls 80, and 120, respectively. The cuts 102, 142 extend upwardly to respective top planar facets or cuts 104 and 144 and extend rearwardly from respective sides 84, 124 to respective tapered tips 106, 146 having respective upper side edges 108,148 transitioning into top rear relief cuts 110, 150 downwardly and rearwardly extending from top planar facets 104 and 144 and from the upper side edges 108, 148 to the rear side surfaces 116, 156 (FIG. 11) of the of the rear sight 70. Furthermore, rear side undercuts 114, 154 (FIG. 11) are respectively made on interior rear lower portions of the left and right sidewalls 80 and 120 and extend rearwardly from respective lower side edges 112, 152 to the rear side surfaces 116, 156 of the of the rear sight 70.

In use and operation, and referring to FIGS. 1-12, the sight system 10 is designed and adjusted such that when respective lateral sighting points of both front and rear sights actually appear to just touch evenly or actually appear to be in a juxtaposed substantially laterally gap-less relation, the firearm is in exact alignment with whatever part of the target just sits on the apex or top sighting point of the front sight. A user looks through the contoured sight opening 158, aligns by visually touching either or both of the rear lateral sighting points 88, 128 with its respective front lateral sighting point of the pair of front lateral sighting points 48, 50, and simultaneously visually touches the top sighting point of the front sight with an exact area desired on a target for providing accurate alignment of the gun and a projectile emanating therefrom. A "touch the points, pull the trigger" gun sight system is thus provided. Hence, the user only has to remember that "when the points touch, pull the trigger." There are no gaps or guessing. The visual information is exact. The touching front and rear lateral sighting points account for both horizontal and vertical alignment of the gun. The top sighting point of the front sight sits exactly where impact of a projectile is desired. Though there may be variations to the exact shape of the front and rear sights, the consistent theme is that the touching points of the front and rear sights determine the horizontal and vertical alignment of the gun, while the apex of the front sight then transfers this alignment to an exact point on the target.

Figure 23:
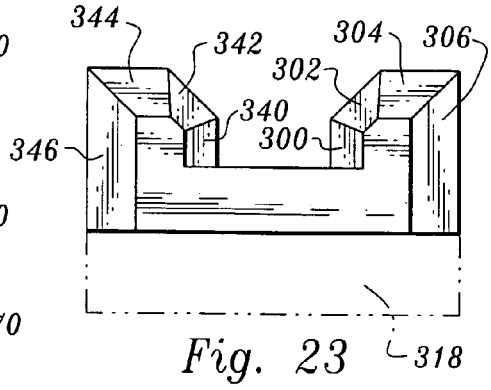
FIG. 23 is a back plan view of the rear sight shown in FIG. 13.
Figure 21:
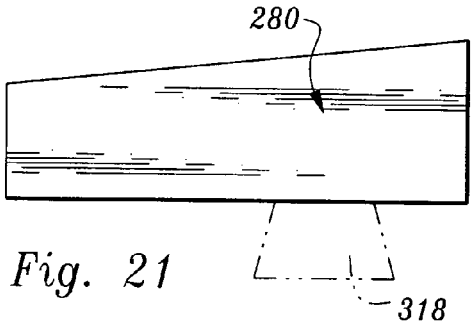
FIG. 21 is a side plan view of the rear sight shown in FIG. 13.
Figure 24:
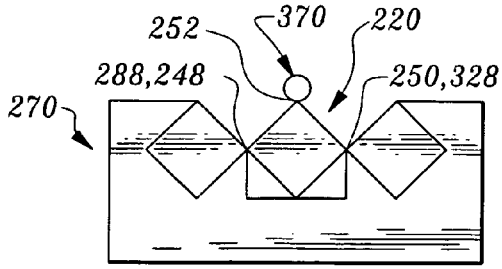
FIG. 24 is a front plan view of aligned front and rear sights of the gun sight system shown in FIG. 13, and with a target shown as a dot aligned with the sighting system.

Referring to FIGS. 13-24, and in another embodiment of the invention, the present invention provides a gun sight system 210 comprised of a geometrically shaped front sight 220 and a geometrically shaped rear sight 270. The geometrically shaped front sight 220 is coupled to a forward end 214 of a gun 212 and comprises a front face 244 having a peripheral outline converging to a top sighting point 252 and a pair of opposing front lateral sighting points 248, 250. The geometrically shaped rear sight 270 is attached to a rearward end 218 of the gun 212 behind the front sight 220 and comprises a pair of spaced apart upwardly extending sidewalls 280, 320 defining a sight opening 358 therebetween and respectively including inwardly projecting members 282, 322 each terminating to respective common end points 288, 328 disposed within the sight opening 358 for defining a pair of opposed spaced apart rear lateral sighting points 288, 328 each respectively juxtaposed to one of the pair of opposing front lateral sighting points 248, 250 for indexing by visually touching either or both of the rear lateral sighting points 288, 328 with its respective juxtaposed front lateral sighting point 248, 250 such that the visually touched points are juxtaposed in a substantially laterally gap-less relation as shown in FIG. 24 and by simultaneously visually touching the top sighting point 252 of the front sight 220 with an area on a target 370 for providing accurate alignment of the gun 212 and a projectile emanating therefrom with the target for providing a "touch the points, pull the trigger" gun sight system 210.

More specifically, and referring to FIGS. 13-24, the gun sight system 210 comprises a geometrically shaped front sight 220 and a geometrically shaped rear sight 270 featuring point-to-point alignment for use with the gun or firearm 212 such as, for example, a trigger actuated pistol, rifle, or shotgun. The geometrically shaped front sight 220 is preferably formed from a single monolith of material and comprises a lowermost rectangular portion 222 surmounted by upper faceted portion 242. As shown in FIG. 13, the lowermost rectangular portion 222 longitudinally extends along a forward end 214 of the gun 212 and is operatively coupled thereto by a dove tail shaped base portion 216 being set crosswise to and downwardly extending from a substantially planar bottom surface 224 (FIG. 17) of the lowermost rectangular portion 222 of the front sight 220 and being fitted to the forward end 214 of the gun 212 in a conventional manner. The base portion 216 may of course be of any desired sectional form and may be integrally formed with the lowermost rectangular portion 222 or attached to the lowermost rectangular portion 222 of the front sight 220 by attachment methods such as by screw, welding, or adhesive. Additionally, the lowermost rectangular portion 222 may take different sectional forms and be attached to the upper faceted portion 242 by being integrally formed therewith or attached thereto by attachment methods such as by screw, welding, or adhesive.

Referring to FIGS. 13-18, the lowermost rectangular portion 222 further includes a front side 226, a rear side 228, and a pair of sidewalls 238 and 240 upwardly extending from the substantially planar bottom surface 224 and transitioning into the upper faceted portion 242 of the front sight 220 and rearwardly extending and inwardly tapering from the front side 226 to the rear side 228 such that the lowermost rectangular portion 222 tapers from the front side 226 to the rear side 228.

The upper faceted portion 242 surmounts the lowermost rectangular portion 222 and comprises a substantially diamond shaped front face 244 defined by a square shaped front face which is turned on one point 246 for obtaining a pair of opposed front lateral sighting points 248 and 250 which extend directly out to either side, and an apex defining a top sighting point 252 which extends directly upwards. This diamond shaped front face 244 includes two pair of substantially parallel front side edges 254, 256 and 255, 257. Preferably, the upper faceted portion 242 is contoured to substantially eliminate extra material protruding to front side edges 254, 255, 256, and 257 of the diamond shaped front face 244 for minimizing visual interference with visualization of the target. Specifically, the upper faceted portion 242 is contoured to substantially eliminate extra material protruding to front side edges and comprises a pair of opposed rearwardly tapering top side rectangular relief cuts 262, 264 formed by removing material behind the top sightings point 252, the front lateral sightings points 248 and 250, and the pair of top side front edges 254 and 255. The pair of relief cuts 262, 264 both rearwardly extend and downwardly decline from a common point defined by the top sightings point 252 to the rear side surface 228 of the lowermost rectangular portion 222 of the front sight 220.

Referring to FIGS. 19-24 and back to FIG. 13, the gun sight system 210 further comprises the geometrically shaped rear sight 270 preferably formed from a single monolith of material and comprised of a rear sight block member 272 which includes a substantially rectangular base plate or member 274 having a substantially planar upper surface 276 and a substantially planar bottom surface 278. The rear sight block member 272 is coupled to a rearward end 218 of the gun 212 in a crosswise orientation as shown in FIG. 13 wherein a dove tail base portion 318 downwardly extends from and is operatively coupled to the substantially planar bottom surface 278 of the substantially rectangular base member 274 and is fitted to the rearward end 218 of the gun 212 in a conventional manner.

The rear sight block member 272 further comprises a pair of spaced apart sidewalls 280, 320 disposed on opposite sides of the substantially rectangular base member 274 and upwardly extending from the upper surface 276 for defining a sight opening 358 therebetween. The spaced apart sidewalls 280, 320 respectively include inwardly projecting members 282, 322 each terminating to a respective pair of non-colinear front edges 284, 286 and 324, 326 wherein each pair of non-colinear front edges 284, 286 and 324, 326 terminate to respective common end points 288, 328 disposed within the sight opening 358 and on each opposing side of a vertical intervening axis 360 for defining a pair of opposed spaced apart rear lateral sighting points 288, 328.

Figure 19:
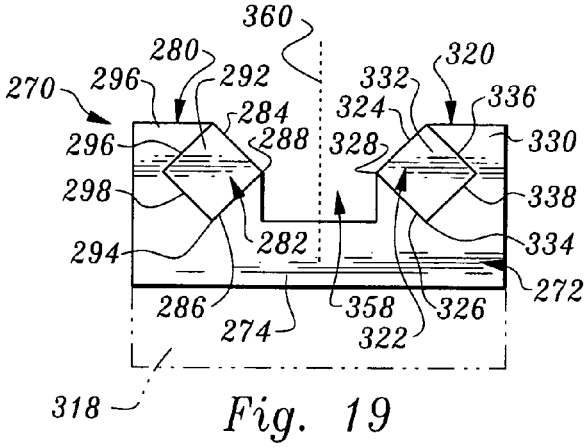
FIG. 19 is a front plan view of the rear sight shown in FIG. 13.
Figure 22:
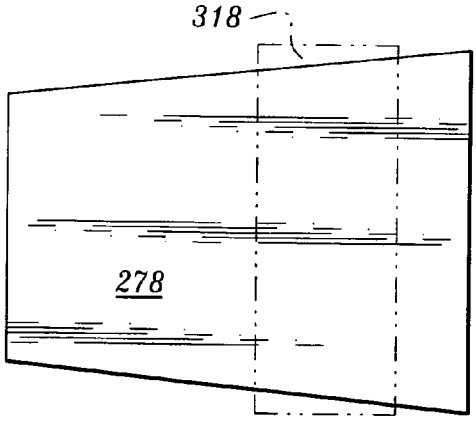
FIG. 22 is a bottom plan view of the rear sight shown in FIG. 13.

More specifically, and referring to FIG. 19, sidewall 280 defines a left sidewall comprised of a front surface 290 having a substantially diamond shaped front face 292 defined by a square shaped face turned on one point 294 for defining the inwardly projecting member 282 terminating to the rear lateral sighting point 288. Similarly, sidewall 320 defines a right sidewall comprised of a front surface 330 having a substantially diamond shaped front face 332 defined by a square shaped face turned on one point 334 for defining the inwardly projecting member 322 terminating to the rear lateral sighting point 328 in an opposing relation relative to rear lateral sighting point 288.

Figure 20:
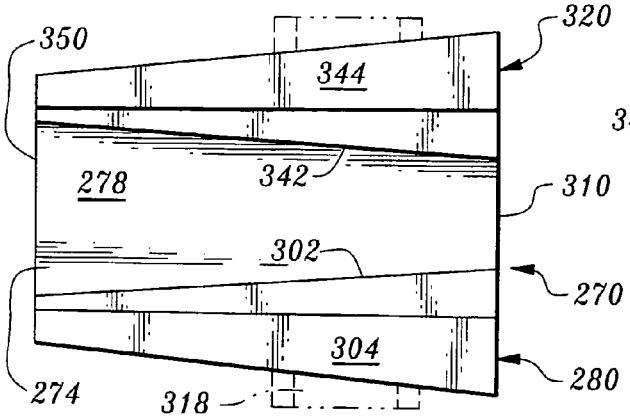
FIG. 20 is a top plan view of the rear sight shown in FIG. 13.

Referring to FIGS. 19, 20, 23 and back to FIG. 13, the sight opening 358 preferably defines a central portion cut out of the rear sight block which is contoured around the pair of opposed spaced apart rear lateral sighting points 288, 328 of the two diamond shaped front faces 292, 332 to substantially eliminate extra material protruding to sides of the diamond shaped front faces 292, 332 such that the front lateral sighting points 248, 250 of the front sight 220 can be visualized clearly and exactly between the pair of opposed spaced apart rear lateral sighting points 288, 328 of the rear sight 270. In one embodiment, the sight opening 358 is contoured by providing longitudinal cuts 300, 340 on interior lower most portions of the left and right sidewalls 280, 320 respectively. Cuts 300 and 340 diverge outwardly and rearwardly from a front side 310 to a rear side 350 of the rear sight 270. Additionally, top side cuts 302, 342 are respectively made on interior upper portions of the left and right sidewalls 280, and 320, respectively. The cuts 302, 342 extend upwardly to respective top planar facets or cuts 304 and 344 and rearwardly extend and downwardly decline from the front side 310 to the rear side 350 of the rear sight 270 and taper from the front side 310 to the rear side 350. The top planar facets or cuts 304 and 344 rearwardly extend and downwardly decline from the front side 310 to the rear side 350 of the rear sight 270 and taper from the front side 310 to the rear side 350.

In use and operation, and referring to FIGS. 13-24, the sight system 210 is designed and adjusted such that when respective lateral sighting points of both front and rear sights actually appear to just touch evenly or actually appear to be in a juxtaposed substantially laterally gap-less relation, the firearm is in exact alignment with whatever part of the target just sits on the apex or top sighting point of the front sight. A user looks through the contoured sight opening 358, aligns by visually touching either or both of the rear lateral sighting points 288, 328 with its respective front lateral sighting point of the pair of front lateral sighting points 248, 250, and simultaneously visually touches the top sighting point 252 of the front sight with an exact area desired on a target for providing accurate alignment of the gun and a projectile emanating therefrom with the target for providing a "touch the points, pull the trigger" gun sight system. Hence, the user only has to remember that "when the points touch, pull the trigger." There are no gaps or guessing. The visual information is exact. The touching front and rear lateral sighting points account for both horizontal and vertical alignment of the gun. The top sighting point of the front sight sits exactly where impact of a projectile is desired. Though there may be variations to the exact shape of the front and rear sights, the consistent theme is that the touching points of the front and rear sights determine the horizontal and vertical alignment of the gun, while the apex of the front sight then transfers this alignment to an exact point on the target.

Figure 25:
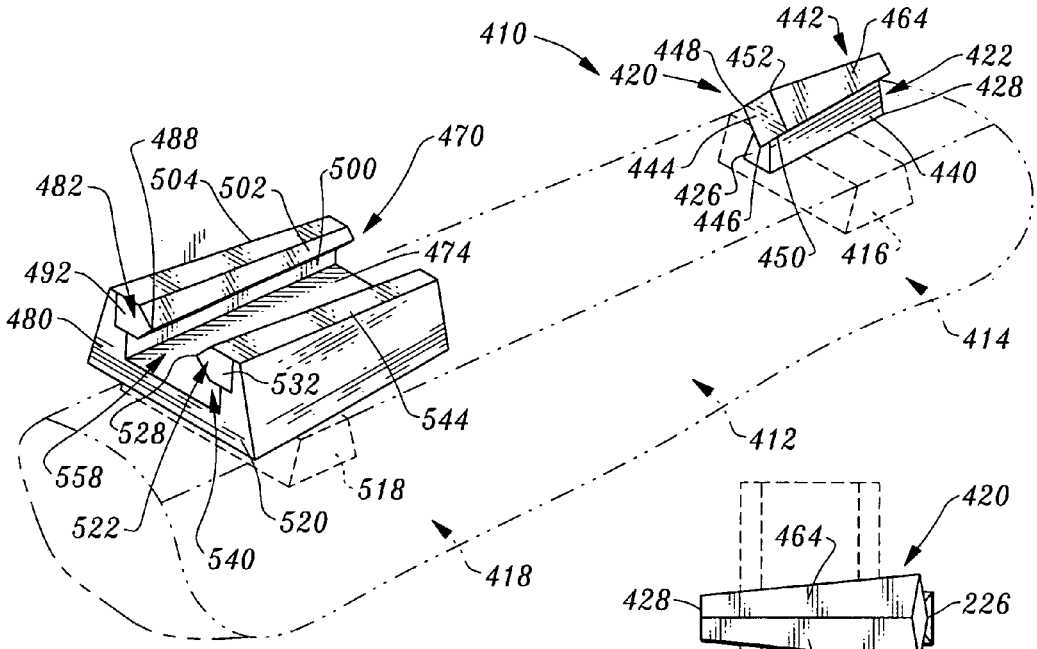
FIG. 25 is a perspective view of another embodiment of a gun sight system including a front sight and a rear sight shown mounted on a gun illustrated in fragment and phantom.
Figure 27:
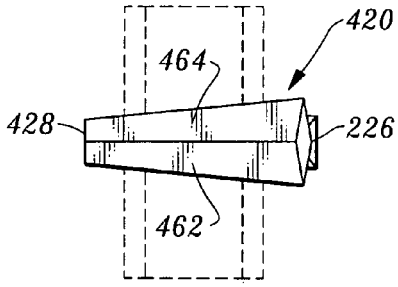
FIG. 27 is a top plan view of the front sight shown in FIG. 25.
Figure 26:
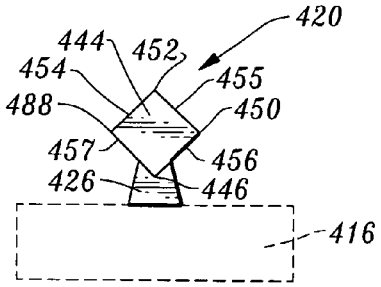
FIG. 26 is a front plan view of the front sight shown in FIG. 25.
Figure 28:
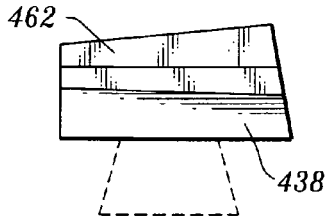
FIG. 28 is a side plan view of the front sight shown in FIG. 25.
Figure 29:
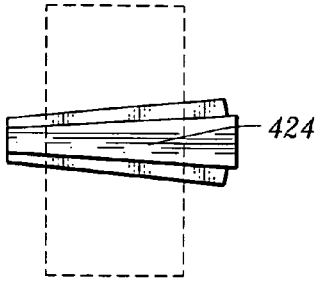
FIG. 29 is a bottom plan view of the front sight shown in FIG. 25.
Figure 30:
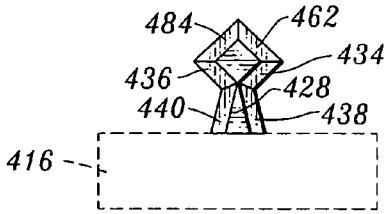
FIG. 30 is a back plan view of the front sight shown in FIG. 25.
Figure 32:
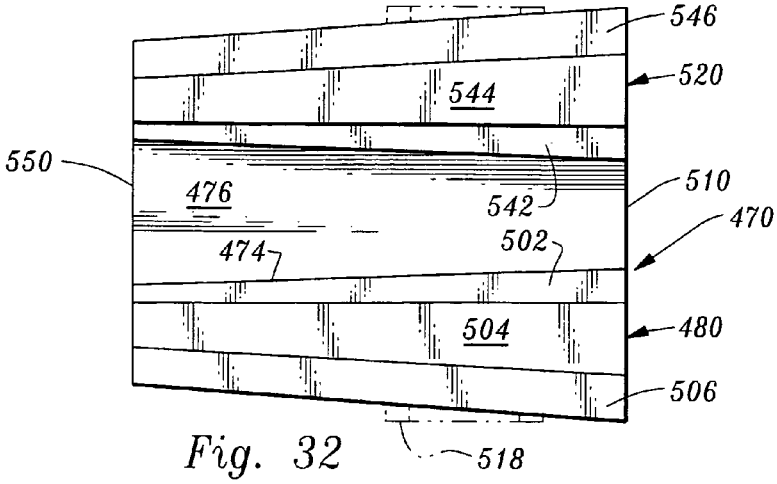
FIG. 32 is a top plan view of the rear sight shown in FIG. 25.
Figure 31:
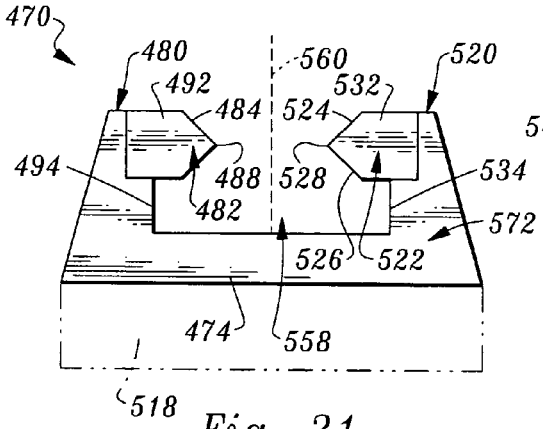
FIG. 31 is a front plan view of the rear sight shown in FIG. 25.
Figure 34:
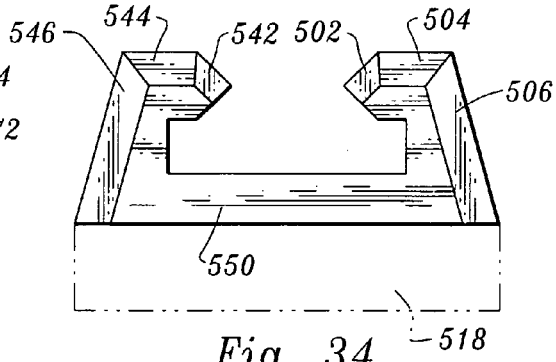
FIG. 34 is a back plan view of the rear sight shown in FIG. 25.
Figure 33:
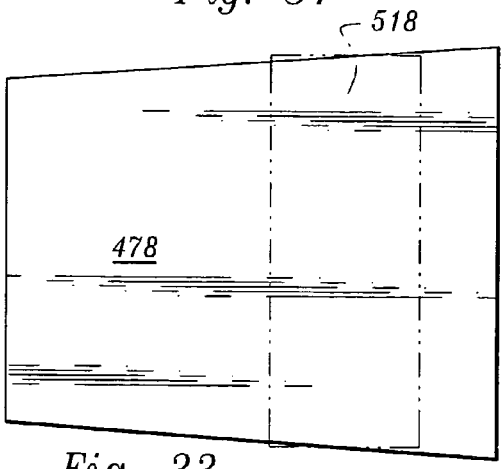
FIG. 33 is a bottom plan view of the rear sight shown in FIG. 25.
Figure 35:
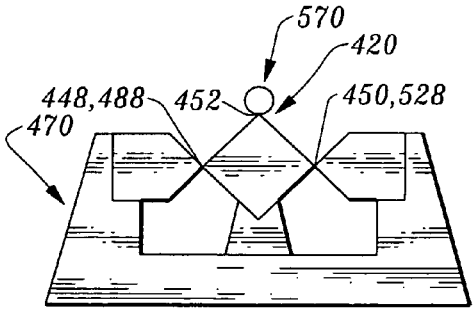
FIG. 35 is a front plan view of aligned front and rear sights of the gun sight system shown in FIG. 25, and with a target shown as a dot aligned with the sighting system.

Referring to FIGS. 25 and 35, and in another embodiment of the invention, the present invention provides a gun sight system 410 comprised of a geometrically shaped front sight 420 and a geometrically shaped rear sight 470. The geometrically shaped front sight 420 is coupled to a forward end 414 of a gun 412 and comprises a front face 444 having a peripheral outline converging to a top sighting point 452 and a pair of opposing front lateral sighting points 448, 450. The geometrically shaped rear sight 470 is attached to a rearward end 418 of the gun 412 behind the front sight 420 and comprises a pair of spaced apart upwardly extending sidewalls 480, 520 defining a sight opening 558 therebetween and respectively including inwardly projecting members 482, 522 each terminating to respective common end points 488, 528 disposed within the sight opening 558 for defining a pair of opposed spaced apart rear lateral sighting points 488, 528 each respectively juxtaposed to one of the pair of opposing front lateral sighting points 448, 450 for indexing by visually touching either or both of the rear lateral sighting points 488, 528 with its respective juxtaposed front lateral sighting point 448, 450 such that the visually touched points are juxtaposed in a substantially laterally gap-less relation as shown in FIG. 35 and by simultaneously visually touching the top sighting point 452 of the front sight 420 with an area on a target 570 for providing accurate alignment of the gun 412 and a projectile emanating therefrom with the target for providing a "touch the points, pull the trigger" gun sight system 410.

More specifically, and referring to FIGS. 25-35, the gun sight system 410 comprises geometrically shaped front sight 420 and geometrically shaped rear sight 470 featuring point-to-point alignment for use with the gun or firearm 412 such as, for example, a trigger actuated pistol, rifle, or shotgun. The geometrically shaped front sight 420 is preferably formed from a single monolith of material and comprises a lowermost rectangular portion 422 surmounted by upper faceted portion 442. As shown in FIG. 25, the lowermost rectangular portion 422 longitudinally extends along the forward end 414 of the gun 412 and is operatively coupled thereto by a dove tail shaped base portion 416 being set crosswise to and downwardly extending from a substantially planar bottom surface 424 of the lowermost rectangular portion 422 of the front sight 420 and being fitted to the forward end 414 of the gun 412 in a conventional manner. The base portion 416 may of course be of any desired sectional form and may be integrally formed with the lowermost rectangular portion 422 or attached to the lowermost rectangular portion 422 of the front sight 420 by attachment methods such as by screw, welding, or adhesive. Additionally, the lowermost rectangular portion 422 may take different sectional forms and be attached to the upper faceted portion 442 by being integrally formed therewith or attached thereto by attachment methods such as by screw, welding, or adhesive.

Referring to FIGS. 25-30, the lowermost rectangular portion 422 further includes a front side 426, a rear side 428, and a pair of sidewalls 438 and 440 upwardly extending from the substantially planar bottom surface 424 and transitioning into the upper faceted portion 442 of the front sight 420 and rearwardly extending and inwardly tapering from the front side 426 to the rear side 428 such that the lowermost rectangular portion 422 tapers from the front side 426 to the rear side 428.

The upper faceted portion 442 surmounts the lowermost rectangular portion 422 and comprises a substantially diamond shaped front face 444 defined by a square shaped front face which is turned on one point 446 for obtaining a pair of opposed front lateral sighting points 448 and 450 which extend directly out to either side, and an apex defining a top sighting point 452 which extends directly upwards. This diamond shaped front face 444 has a peripheral outline comprised of two pair of substantially parallel front side edges 454, 456 and 455, 457. Preferably, the upper faceted portion 442 is contoured to substantially eliminate extra material protruding to front side edges 454, 455, 456, and 457 of the diamond shaped front face 444 for minimizing visual interference with visualization of the target. Specifically, the upper faceted portion 442 is contoured to substantially eliminate extra material protruding to front side edges and comprises a pair of opposed top side rectangular relief cuts 462, 464 formed by removing material behind the top sightings point 452, the front lateral sightings points 448 and 450, and the pair of top side front edges 454 and 455. The pair of relief cuts 462, 464 both rearwardly and downwardly extend from a common point, the top sightings point 452, to the rear side surface 428 of the lowermost rectangular portion 422 of the front sight 420.

Referring to FIGS. 31-35 and back to FIG. 25, the gun sight system 410 further comprises the geometrically shaped rear sight 470 preferably formed from a single monolith of material and comprised of a rear sight block member 472 which includes a substantially rectangular base plate or member 474 having a substantially planar upper surface 476 and a substantially planar bottom surface 478. The rear sight block member 472 is coupled to a rearward end 418 of the gun 412 in a crosswise orientation as shown in FIG. 25 wherein a dove tail base portion 518 downwardly extends from and is operatively coupled to the substantially planar bottom surface 478 of the substantially rectangular base member 474 and is fitted to the rearward end 418 of the gun 412 in a conventional manner.

The rear sight block member 472 further comprises a pair of spaced apart sidewalls 480, 520 disposed on opposite sides of the substantially rectangular base member 474 and upwardly extending from the upper surface 476 for defining a sight opening 558 therebetween. The spaced apart sidewalls 480, 520 respectively include inwardly projecting members 482, 522 each terminating to a respective pair of non-colinear front edges 484, 486 and 524, 526 wherein each pair of non-colinear front edges 484, 486 and 524, 526 terminate to respective common end points 488, 528 disposed within the sight opening 558 and on each opposing side of a vertical intervening axis 560 for defining a pair of opposed spaced apart rear lateral sighting points 488, 528.

More specifically, sidewall 480 defines a left sidewall comprised of a substantially pentagon shaped front face 492 defining the inwardly projecting member 482 terminating to the rear lateral sighting point 488. Similarly, sidewall 520 defines a right sidewall comprised of a substantially pentagon shaped front face 532 defining the inwardly projecting member 522 terminating to the rear lateral sighting point 528 in an opposing relation relative to rear lateral sighting point 488.

The sight opening 558 preferably defines a central portion cut out of the rear sight block which is contoured around the pair of opposed spaced apart rear lateral sighting points 488, 528 of the two pentagon shaped front faces 492, 532 to substantially eliminate extra material protruding to sides of the diamond shaped front faces 492, 532 such that the front lateral sighting points 448, 250 of the front sight 420 can be visualized clearly and exactly between the pair of opposed spaced apart rear lateral sighting points 488, 528 of the rear sight 470. In one embodiment, the sight opening 558 is contoured by providing longitudinal cuts 500, 540 on interior lower most portions of the left and right sidewalls 480, 520 respectively. Additionally, top side cuts 502, 542 are respectively made on interior upper portions of the left and right sidewalls 480 and 520 respectively. The cuts 502, 542 extend upwardly to respective top planar facets or cuts 504 and 544.

In use and operation, and referring to FIGS. 25-35, the sight system 410 is designed and adjusted such that when respective lateral sighting points of both front and rear sights actually appear to just touch evenly or actually appear to be in a juxtaposed substantially laterally gap-less relation, the firearm is in exact alignment with whatever part of a target just sits on the apex or top sighting point of the front sight. Particularly, a user looks through the contoured sight opening 558, aligns by visually touching either or both of the rear lateral sighting points 488, 528 with its respective front lateral sighting point of the pair of front lateral sighting points 448, 450, and simultaneously visually touches the top sighting point 452 of the front sight with an exact area desired on a target 570 for providing accurate alignment of the gun and a projectile emanating therefrom with the target for providing a "touch the points, pull the trigger" gun sight system. Hence, the user only has to remember that "when the points touch, pull the trigger." There are no gaps or guessing. The visual information is exact. The touching front and rear lateral sighting points account for both horizontal and vertical alignment of the gun. The top sighting point of the front sight sits exactly where impact of a projectile is desired. Though there may be variations to the exact shape of the front and rear sights, the consistent theme is that the touching points of the front and rear sights determine the horizontal and vertical alignment of the gun, while the apex of the front sight then transfers this alignment to an exact point on the target.

Referring to FIGS. 36-39, and in another embodiment of the invention, the present invention provides a gun sight system 610 comprised of the geometrically shaped front sight 420 described in detail above and a geometrically shaped rear sight 670. The geometrically shaped front sight 420 is coupled to a forward end 614 of a gun 612 and comprises front face 444 having the top sighting point 452 and the pair of opposing front lateral sighting points 448, 450.

The geometrically shaped rear sight 670 is attached to a rearward end 618 of the gun 612 behind the front sight 420 and comprises a pair of spaced apart upwardly extending sidewalls 680, 720 defining a sight opening 758 therebetween and respectively including inwardly projecting members 682, 722 each terminating to respective common end points 688, 728 disposed within the sight opening 758 for defining a pair of opposed spaced apart rear lateral sighting points 688, 728 each respectively juxtaposed to one of the pair of opposing front lateral sighting points 448, 450 for indexing by visually touching either or both of the rear lateral sighting points 688, 728 with its respective juxtaposed front lateral sighting point 448, 450 such that the visually touched points are juxtaposed in a substantially laterally gap-less relation as shown in FIG. 35 and by simultaneously visually touching the top sighting point 452 of the front sight 420 with an area on a target 770 for providing accurate alignment of the gun 612 and a projectile emanating therefrom with the target for providing a "touch the points, pull the trigger" gun sight system 610.

More specifically, and referring to FIGS. 36-39, the gun sight system 610 comprises the geometrically shaped front sight 420 delineated above and also illustrated in FIGS. 27-30 and the geometrically shaped rear sight 670 featuring point-to-point alignment for use with the gun or firearm 612 such as, for example, a trigger actuated pistol, rifle, or shotgun. As noted above, the geometrically shaped front sight 420 is preferably formed from a single monolith of material and comprises lowermost rectangular portion 422 surmounted by upper faceted portion 442.

The gun sight system 610 further comprises the geometrically shaped rear sight 670 preferably formed from a single monolith of material and comprised of a rear sight block member 672 which includes a substantially rectangular base plate or member 674 having a substantially planar upper surface 676 and a substantially planar bottom surface 678. The rear sight block member 672 is coupled to a rearward end 618 of the gun 612 in a crosswise orientation as shown in FIG. 36 wherein a dove tail base portion 718 downwardly extends from and is operatively coupled to the substantially planar bottom surface 678 of the substantially rectangular base member 674 and is fitted to the rearward end 618 of the gun 612 in a conventional manner.

The rear sight block member 672 further comprises a pair of spaced apart sidewalls 680, 720 disposed on opposite sides of the substantially rectangular base member 674 and upwardly extending from the upper surface 676 for defining a sight opening 758 therebetween. The spaced apart sidewalls 680, 720 respectively include inwardly projecting members 682, 722 each terminating to a respective pair of non-colinear front edges 684, 686 and 724, 726 wherein each pair of non-colinear front edges 684, 686 and 724, 726 terminate to respective common end points 688, 728 disposed within the sight opening 758 and on each opposing side of a vertical intervening axis 760 for defining the pair of opposed spaced apart rear lateral sighting points 688, 728.

More specifically, sidewall 680 defines a left sidewall comprised of a substantially triangular shaped front face 692 defining the inwardly projecting member 682 terminating to the rear lateral sighting point 688. Similarly, sidewall 720 defines a right sidewall comprised of a substantially triangular shaped front face 732 defining the inwardly projecting member 722 terminating to the rear lateral sighting point 728 in an opposing relation relative to rear lateral sighting point 688.

The sight opening 758 preferably defines a central portion cut out of the rear sight block which is contoured around the pair of opposed spaced apart rear lateral sighting points 688, 728 of the two triangular shaped front faces 692, 732 to substantially eliminate extra material protruding to sides of the diamond shaped front faces 692, 732 such that the front lateral sighting points 448, 450 of the front sight 420 can be visualized clearly and exactly between the pair of opposed spaced apart rear lateral sighting points 688, 728 of the rear sight 670. In one embodiment, the sight opening 758 is contoured by providing longitudinal cuts 700, 740 on interior lower most portions of the left and right sidewalls 480, 720 respectively. Additionally, top cuts 702, 742 are respectively made on upper portions of the left and right sidewalls 680 and 720 respectively.

In use and operation, and referring to FIGS. 36-39, the sight system 610 is designed and adjusted such that when respective lateral sighting points of both front and rear sights actually appear to just touch evenly or actually appear to be in a juxtaposed substantially laterally gap-less relation, the firearm is in exact alignment with whatever part of the target just sits on the apex or top sighting point of the front sight. A user looks through the contoured sight opening 758, aligns by visually touching either or both of the rear lateral sighting points 688, 728 with its respective front lateral sighting point of the pair of front lateral sighting points 448, 450, and simultaneously visually touches the top sighting point 452 of the front sight with an exact area desired on a target 770 for providing accurate alignment of the gun and a projectile emanating therefrom with the target for providing a "touch the points, pull the trigger" gun sight system. Hence, the user only has to remember that "when the points touch, pull the trigger." There are no gaps or guessing. The visual information is exact. The touching front and rear lateral sighting points account for both horizontal and vertical alignment of the gun. The top sighting point of the front sight sits exactly where impact of a projectile is desired. Though there may be variations to the exact shape of the front and rear sights, the consistent theme is that the touching points of the front and rear sights determine the horizontal and vertical alignment of the gun, while the apex of the front sight then transfers this alignment to an exact point on the target.

Figure 40:
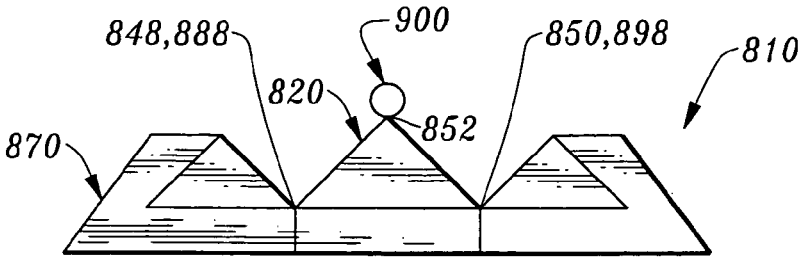
FIG. 40 is a front plan view of another embodiment of a gun sight system including front and rear sights shown aligned, and with a target shown as a dot aligned with the sighting system.
Figure 41:
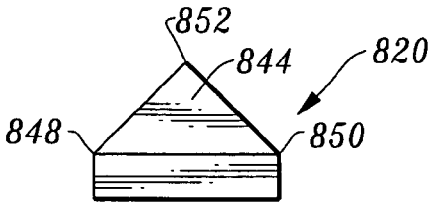
FIG. 41 is a front plan view of the front sight shown in FIG. 40.
Figure 42:
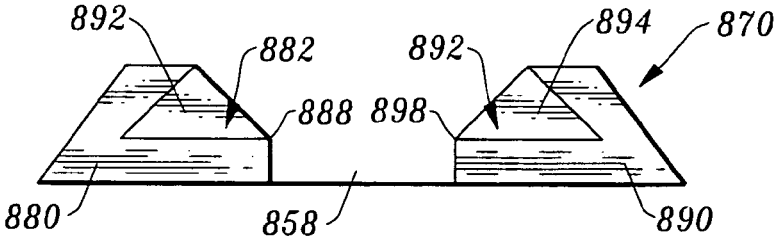
FIG. 42 is a front plan view of the rear sight shown in FIG. 40.

Referring to FIGS. 40-42, and in another embodiment of the invention, the present invention provides a gun sight system 810 comprised of a front sight 820 and a rear sight 870. The front sight 820 comprises triangular front face 844 having the top sighting point 852 and the pair of opposing front lateral sighting points 848, 850.

The geometrically shaped rear sight 870 is disposed behind the front sight 820 and comprises a pair of spaced apart upwardly extending sidewalls 880, 890 defining a sight opening 858 therebetween. The sidewalls 880, 890 respectively include inwardly projecting triangular members 882, 892 having respective lateral end points 888, 898 disposed within the sight opening 858 for defining a pair of opposed spaced apart rear lateral sighting points 888, 898. These points 888, 898 can be juxtaposed to one of the pair of opposing front lateral sighting points 848, 850 for indexing by visually touching either or both of the rear lateral sighting points 888, 898 with its respective juxtaposed front lateral sighting point 848, 850. The visually touched points can be juxtaposed in a substantially laterally gap-less relation as shown in FIG. 40 and simultaneously have the top sighting point 852 visually touch an area on a target 900. Accurate alignment of a gun and a projectile emanating therefrom with the target is thus provided for a "touch the points, pull the trigger" gun sight system 810.

In use and operation, and referring to FIGS. 40-42, the sight system 810 is designed and adjusted such that when respective lateral sighting points of both front and rear sights actually appear to just touch evenly or actually appear to be in a juxtaposed substantially laterally gap-less relation, the firearm is in exact alignment with whatever part of the target just sits on the apex or top sighting point of the front sight. A user looks through the contoured sight opening 858, aligns by visually touching either or both of the rear lateral sighting points 888, 898 with its respective front lateral sighting point of the pair of front lateral sighting points 848, 850 and simultaneously visually touches the top sighting point 852 of the front sight with an exact area desired on a target 900 for providing accurate alignment of a gun and a projectile emanating therefrom with the target for providing a "touch the points, pull the trigger" gun sight system.

Figure 43:
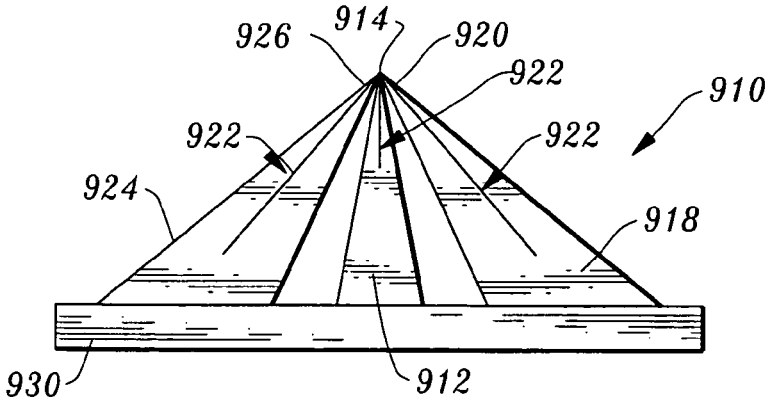
FIG. 43 is a front plan view of another embodiment of a gun sight system including front and rear sights shown aligned.

Referring to FIG. 43 and in another embodiment of the invention, the present invention provides a gun sight system 910 including a front sight 912 and two rear sights 918, 924. The front sight 912 is configured to be a pyramid shape and attached to a forward end of a gun and including an uppermost end 914 terminating to a front sighting point. The pair of spaced apart upwardly and inwardly slanting triangular rear sights 918, 924 are attached to a rearward end of the gun behind the front sight. The rear sights 918, 924 include a pair or uppermost ends terminating to a pair of spaced apart rear sighting points 920, 926 each alignable with the front sighting point such that visually touching the rear sighting points with the front sighting point and the front sighting point with a target defines a convergence and visual touching of rear and front sighting points to the target for providing accurate alignment of the gun. A "touch the points, pull the trigger" gun sight system 910 is thus provided.

In one embodiment, the pyramid shaped front sight 912 includes a front face substantially shaped as an isosceles triangle. The rear sights 918, 924 include front faces substantially shaped as scalene triangles wherein each scalene triangle has its shortest length acting as a base and its longest length defining an exterior side such that the scalene triangles upwardly and inwardly converge toward one another, with the front sight 912 visually interposed therebetween, as viewed by FIG. 43.

In one embodiment, the gun sight system 910 further includes a front interior line 922 disposed on the front face of the pyramid shaped front sight 912 and a rear interior line 922 disposed on a front face of each of the rear sights 918, 924 for drawing focal vision of a user to an area of finest detail defined by the absolute front and rear sighting points whose convergence and visual contact defines the point of gun shot impact. The interior lines are preferably of bright or contrasting colors to heighten visual tracking by peripheral vision of a user. In one embodiment, the interior lines are red.

The gun sight system 910 preferably further provides the front and rear sights 912, 918, 924 with bright colors to heighten visual tracking by peripheral vision of a user. The front and rear sights 912, 918, 924 can be provided with contrasting colors to heighten visual tracking by peripheral vision of a user.

In one embodiment, the gun sight system 910 further includes providing the front and rear sights with tops physically sloped away from a user's eye, using depth perception to further stimulate the user's focal vision instinct to be drawn to areas of finer detail at the target and tips 914, 920, 926 of the sights 912, 918, 924. Other details of the sight portions can vary, with the appearance and position of the sights 912, 918, 924 when viewed from the rear being most important.

Figure 44:
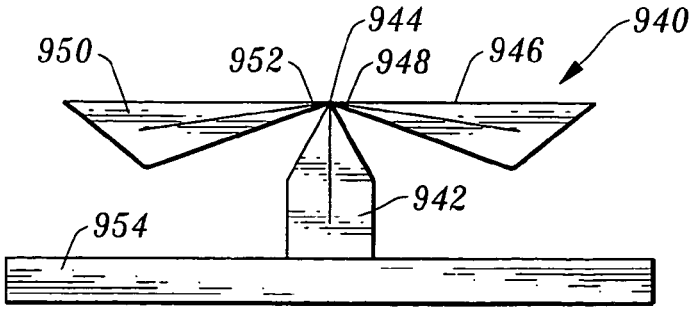
FIG. 44 is a front plan view of another embodiment of a gun sight system including front and rear sights shown aligned.

Referring to FIG. 44, details of another alternative embodiment sight 940 of this invention is described. The sight 940 is similar to the sight 900 (FIG. 43) except that the shape and orientation of the various different portions of the sight have been modified slightly. Particularly, the front sight 942, in this embodiment, initially has vertically oriented parallel walls, and then tapers to a front sighting point 944. The two rear sights 946, 950 are mirror images of each other and symmetrical about a vertical centerline of the front sight 942. In particular, the rear sights 946, 950 would be suspended in some fashion up from a base 954 (generally representing an upper surface of a barrel of the gun).

The rear sights 946, 950 are shown detached from the base 954, to illustrate that numerous different support structures could be provided to suspend the rear sights 946, 950 where shown. The rear sights 946, 950 are preferably triangular with side edges which angle towards each other and converge at rear sighting points 948, 952 only slightly spaced from each other.

Preferably, in this embodiment, uppermost edges of the rear sights 946, 950 are horizontal. Also, interior lines similar to the interior lines 922 of the sight 910 (FIG. 43) can also be provided with this sight 940 of FIG. 44. The lines are optionally reflective or easily visualized colors are provided on the surfaces of the sight 940 which are visualized by the eye, to enhance visual recognition by a user.

The embodiments of FIGS. 43 and 44 differ slightly in general principle from the embodiments of FIGS. 1-42. In particular, with the embodiments of FIGS. 1-42 a user generally follows a two step process in utilizing the sight to align the gun. First, the user aligns one of the rear sighting points with one of the lower front side sighting points. This alignment occurs by visually touching the points together. Specifically, the eye of the user is precisely aligned with both the rear sighting point and the front sighting point, so that the barrel of the gun is aligned with the eye of the user. Second, the user aligns a top sighting point on the front sight with the target. Provided that the rear sighting point and the lower front side sighting point are still aligned, the barrel of the gun is precisely aligned with the target which is located at the top sighting point. Hence, the user need merely visually touch the points between the rear sight and the front sight and visually touch the top point on the front sight with the target before pulling the trigger and striking the target with the projectile.

With the embodiment of FIGS. 43 and 44, this system is slightly further simplified. In particular, the front sight does not include a separate top sighting point and lower front side sighting points. Rather, the top sighting point and front sighting point all are together at the tip defining the uppermost end of the front sight 912, 942 (FIGS. 43 and 44). Hence, when the rear sighting point is aligned with this front sighting point, the eye of the user is aligned with the barrel of the gun and the target which is also located at this front sighting point. Hence, with the embodiment of FIGS. 43 and 44, only one alignment step need occur both for aligning the barrel of the gun with the eye of the user and aligning the barrel of the gun with the target. The embodiment of FIGS. 43 and 44 thus represents a further evolution of the general concept of point-to-point contact between front and rear sights which is illustrated in the embodiments of FIGS. 1-42. In practice, some users may find the embodiment of FIGS. 43 and 44 superior to the embodiments of FIGS. 1-42. Other users may find the embodiment of FIGS. 1-42 easier to effectively utilize than the embodiment of FIGS. 43 and 44. Different embodiments may be preferred for different end use scenarios. For example, in law enforcement high visibility and speed in low light conditions may be considered critical, whereas a recreational target shooter may feel pure precision is more important.

Figure 45:
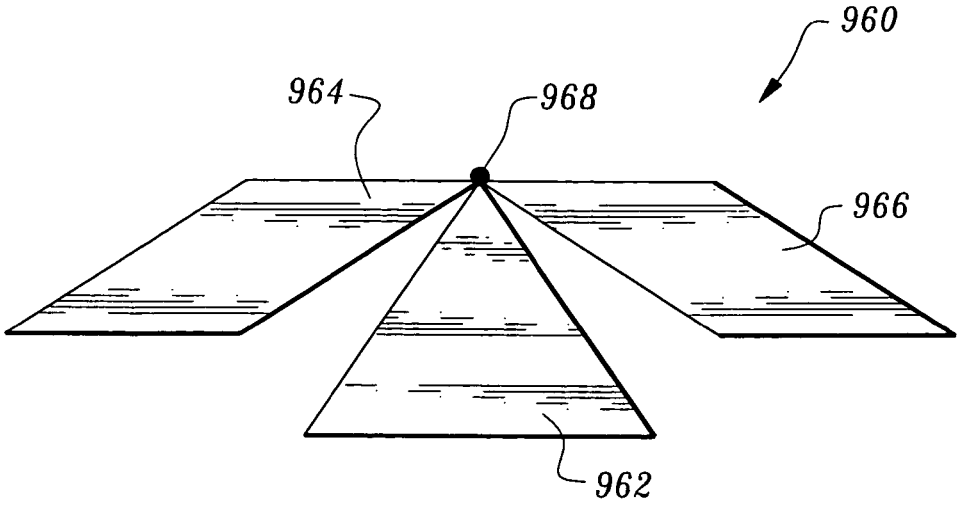
FIG. 45 is a front plan view of another embodiment of a gun sight system including two four-sided parallelogram rear sights and a triangular front sight.

FIG. 45 provides a rear view of a further alternative embodiment gun sight system 960. With this system, the two rear sights 964, 966 have rearwardly facing surfaces which are four-sided and generally in the form of parallelograms. The front sight 962 has a rear face which is triangular. Each of the sight portions 964, 966, 962 include at least linear lines which converge toward a target point 968. As with the embodiment of FIG. 43, the point of the front sight is aligned with and visually touches the points of the rear sights and this common point is aligned with and visually touches the target to provide the firearm in an orientation aligned with the target. As with other embodiments, the rear sights would be mounted to a rear portion of the firearm and the front sight would be mounted to a forward portion of the firearm with appropriate alignment so that when the various portions of the sights 964, 966, 962 are aligned and visually touched together, a projectile emanating from the firearm will be directed toward the target point 968.

Figure 46:
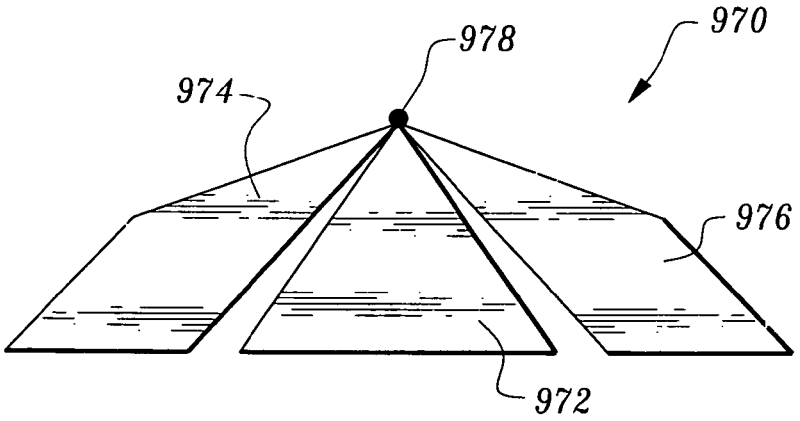
FIG. 46 is a front plan view of another embodiment of a gun sight system including two four-sided irregular rear sights and a triangular front site.

In FIG. 46, a further gun sight system 970 is shown. With this system 970, the rear sight portions 974, 976 have rearwardly facing surfaces which are four-sided, but irregular rather than parallelogram in shape. The front sight 972 has a triangular shape. Each of the sight portions 974, 976, 972 include a pair of lines which converge toward the target point 978. This system 970 of FIG. 46 is similar to the system 960 of FIG. 45 except for the particular shape provided for the rear sight portions 974, 976.

Figure 47:
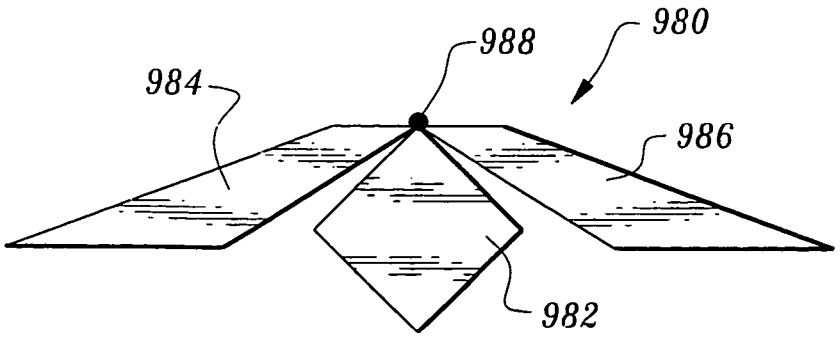
FIG. 47 is a front plan view of another embodiment of a gun sight system including two four-sided irregular rear sights and a diamond shaped front site.

FIG. 47 shows a rear view of a sighting system 980 which provides a still further embodiment of this invention. Two rear sight portions 984, 986 are provided with rearwardly facing surfaces which are four-sided and irregular in shape, with these rear sight portions 984, 986 different from the rear sight portions 974, 976 of FIG. 46. Also, this system 980 includes a front sight 982 with a rearwardly facing surface which is generally four-sided and diamond shaped. As with the systems 960, 970 of FIGS. 45 and 46, each of the sight portions 982, 984, 986 of the system 980 include a pair of converging lines which converge upon a target point 988. The system 980 of FIG. 47 thus provides a still further example of how front and rear sights of various different embodiments of this invention can be configured to still function and provide desirably fast and accurate point-to-point alignment for a firearm utilizing the various different embodiments of this invention. Further details of the system 980 are similar to those described above with respect to the systems 960 and 970 of FIGS. 45 and 46.

With each of the embodiments of this invention, the most important aspect is the appearance of the front sight and rear sights when viewed from the rear by the eye of the user. Hence, the various different shapes provided could be provided by cutting the material forming the front sight and the rear sight into the geometry which has the visual shape desired, or shapes can be painted or otherwise applied to surfaces of the front sight and the rear sight so that the same visual perception is provided, without requiring complex machining of parts. In the most preferred embodiments, the front and rear sights are both shaped with a particular geometry formed into the front and rear sights, as well as provided with paint or other surface treatments to enhance visibility of the front and rear sights to the user. Plastic inserts may also be used, in white or of various contrasting colors, or a plastic with fiber optic qualities, and/or embedded in a base structure manufactured of a clear material, such as Lexan. Such fiber optic material could also be further illuminated from within the base structure by an embedded self-luminescent source such as Tritium.

Furthermore, guiding principles recognized by the present invention include the following: 1) Human visual physiology is designed to move from areas of lesser detail to those of more detail; to move from the general to the specific, from the vague to the precise. 2) Human vision accomplishes this through two complimentary forms of sight: central, or focal vision, and peripheral vision. The peripheral vision works with the subconscious, seeking out critical patterns, shapes or colors, then alerting the conscious mind. The eyes powerful central vision then zeros in on these, searching out the finest detail. In the anatomical structure of the eye, this relates to the Fovea Centralis, a small area in the center of the retina that contains the highest density of visual cells, about 0.3 mm across on the average. Outside of this area, the ability to resolve sharp detail rapidly falls off. Thus closely spaced or fine, touching points are more readily processed and recognized than only widely spaced dots, planes or other combinations of surfaces. 3) The average human eye can resolve detail as fine as a human hair out as much as two feet away. 4) The brain continuously assesses and coordinates visual information from both peripheral and focal vision as it proceeds with a task.

The point-to-point system is designed to work with this physiological reality by incorporating the following: 1) Symmetrical shapes whose outlines converge to absolute points in space (less detail to greater detail); 2) These shapes may utilize bright and/or contrasting colors to heighten visual tracking by the peripheral vision; 3) The addition of fine lines of contrasting colors within these symmetrical shapes; 4) Absolute points in space whose visual relation/alignment/convergence and visual touch determines the exact alignment of rear and front sight and the exact point of impact. Further, the tops of these indicators may be physically sloped away from the user's eye, using depth perception to further stimulate the focal vision's instinct to be drawn to areas of finer detail all these elements function together thus: The peripheral vision is attracted to and locks onto the bright colors/symmetrical shapes, whose converging angles and interior lines draw the focal vision to the area of finest detail, the absolute points in space whose visual alignment/convergence and visual touch reveals the point of impact.

Hence, the present invention is not based on visual guides whose alignment is determined by estimating the spaces or gaps between, but rather symmetrical shapes whose converging lines draw the vision to absolute points in space whose relation, alignment and convergence are the measure of the alignment between front and rear sights and the intended point of impact. In addition, various combinations of colors and lines may be used in conjunction with the geometric shapes to aid in tracking and in guiding the eye to the points of alignment and/or convergence.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A method for rapidly and accurately sighting a firearm, including the steps of:

identifying a front sight attached to a firearm, the front sight having a target point defined by a vertex between a first target point edge line and a second target point edge line, the first target point edge line located on a left side of the target point and extending at least visually up and to the right until the first target point end line terminates at the target point, the second target point end line located on a right side of the target point and extending at least visually up and to the left until the second target point end line terminates at the target point; the front sight having an alignment point taken from the group of points including the target point and a lateral alignment point spaced from the target point; the alignment point defined by a vertex between a first alignment point edge line and a second alignment point edge line;

identifying a rear sight attached to the firearm, the rear sight having at least one rear lateral sighting point, the rear lateral sighting point defined by a vertex between a first rear lateral sighting point edge line and a second rear lateral sighting point edge line, the first rear lateral sighting point edge line and the second rear lateral sighting point edge line oriented non-parallel with each other;

identifying the front sight and the rear sight arranged upon the firearm with a sight line between the target point and a target that is parallel with a centerline of a barrel of the firearm when the center line of the barrel is aligned with the target;

aiming the firearm by visually touching the at least one rear lateral sighting point of the rear sight with the alignment point of the front sight and visually touching the target point with the target;

wherein said identifying a front sight step includes the first target point edge line and the second target point edge line each being straight;

wherein said identifying a rear sight step includes the first and second rear lateral sighting point edge lines being straight; and wherein said identifying a rear sight step includes identifying a pair of similar rear sighting points on either side of the front sight each of the rear sighting points defined by vertices between first rear lateral sighting point edge lines and second rear lateral sight point edge lines, each of the rear sighting points extending toward each other.

2. The method of claim 1 wherein said identifying a front sight step includes the alignment point being the same as the target point.

3. The method of claim 1 wherein said identifying a front sight step includes the alignment point being a lateral alignment point spaced from the target point both laterally from the target point and below the target point.

4. The method of claim 3 wherein said identifying a front sight step includes the front sight having a generally four sided appearance with at least three corners, including a top corner and two lateral corners below the top corner, the top corner defined by the target point, and a pair of lateral alignment points defining the lateral corners of the front sight, the first target point edge line and the second target point edge line each being colinear with one alignment point edge line for each of the pair of lateral alignment points.

5. The method of claim 3 wherein said identifying a front sight step includes the front sight configured as a triangle with an apex corner and two laterally spaced base corners, with the apex corner defining the target point of the front sight and with the laterally spaced base corners defining a pair of the lateral alignment points, and wherein the first target point edge line and the second target point edge line are each colinear with one alignment point edge line for each of the pair of lateral alignment points.

6. The method of claim 1 wherein said identifying a rear sight step includes identifying a pair of symmetrical rear lateral sighting points adapted to be visually located laterally on either side of the front sight.

7. The method of claim 6 wherein said identifying a front sight step includes the front sight having a pair of lateral alignment points spaced from the target point with a spacing between the pair of lateral alignment points similar to a spacing between the rear lateral sighting points of the rear sight.

8. The method of claim 1 wherein the edge lines of the target point and the edge lines of the rear lateral sight points are visual lines printed on surfaces of the front sight and the rear sight.

9. The method of claim 1 wherein the edge lines of the front sight and the rear sight are edge lines defined at least partially by edges in geometry of material forming the front sight and the rear sight.

10. A method for rapidly and accurately sighting a firearm, including the steps of:

selecting a front sight, the front sight having a target point defined by a vertex between a first target point edge line and a second target point edge line, the first target point edge line located on a left side of the target point and extending at least visually up and to the right until the first target point end line terminates at the target point, the second target point end line located on a right side of the target point and extending at least visually up and to the left until the second target point end line terminates at the target point; the front sight having an alignment point taken from the group of points including the target point and a lateral alignment point spaced from the target point; the alignment point defined by a vertex between a first alignment point edge line and a second alignment point edge line;

selecting a rear sight, the rear sight having at least one rear lateral sighting point, the rear lateral sighting point defined by a vertex between a first rear lateral sighting point edge line and a second rear lateral sighting point edge line, the first rear lateral sighting point edge line and the second rear lateral sighting point edge line oriented non-parallel with each other;

attaching the front sight and the rear sight upon a firearm so that a sight line between the target point and a target is parallel with a centerline of a barrel of the firearm when the center line of the barrel is aligned with the target;

configuring the front sight and the rear sight to allow aiming of the firearm by visually touching the at least one rear lateral sighting point of the rear sight with the alignment point of the front sight and visually touching the target point with the target;

wherein said selecting a front sight step includes the first target point edge line and the second target point edge line each being straight;

wherein said selecting a rear sight step includes the first and second rear lateral sighting point edge lines being straight; and wherein said selectin a rear sight step includes selecting a pair of similar rear sighting points on either side of the front sight, each of the rear sighting points defined by vertices between first rear lateral sighing point edge lines and second rear lateral sighting point edge lines, each of the rear sighting points extending toward each other.

11. The method of claim 10 wherein said selecting a front sight step includes the alignment point being a lateral alignment point spaced from the target point both laterally from the target point and below the target point; and wherein said selecting a front sight step includes the front sight having a generally four sided appearance with at least three corners, including a top corner and two lateral corners below the top corner, the top corner defined by the target point, and a pair of lateral alignment points defining the lateral corners of the front sight, the first target point edge line and the second target point edge line each being colinear with one alignment point edge line for each of the pair of lateral alignment points.

* * * * *